US010276331B2

(12) United States Patent
Mika et al.

(10) Patent No.: US 10,276,331 B2
(45) Date of Patent: Apr. 30, 2019

(54) BLOCKING MEMBERS AND CIRCUIT BREAKERS HAVING QUICK-MAKE FEATURE

(71) Applicant: ABB Schweiz AG, Baden (CH)

(72) Inventors: David Peter Mika, Clifton Park, NY (US); Linda Yvonne Jacobs, Barkhamsted, CT (US); Daniel Edward Delfino, Farmington, CT (US); Nagesh V. Tumu, Unionville, CT (US); Dmitry Povolotskiy, Farmington Hills, MI (US)

(73) Assignee: ABB Schweiz AG, Baden (CH)

( * ) Notice: Subject to any disclaimer, the term of this patent is extended or adjusted under 35 U.S.C. 154(b) by 31 days.

(21) Appl. No.: 15/075,338

(22) Filed: Mar. 21, 2016

(65) Prior Publication Data

US 2017/0271107 A1 Sep. 21, 2017

(51) Int. Cl.

| | |
|---|---|
| ***H01H 21/42*** | (2006.01) |
| ***H01H 71/50*** | (2006.01) |
| ***H01H 71/58*** | (2006.01) |
| *H01H 71/52* | (2006.01) |

(52) U.S. Cl.

CPC ..... *H01H 21/42* (2013.01); *H01H 71/505* (2013.01); *H01H 71/58* (2013.01); *H01H 71/528* (2013.01); *H01H 2300/048* (2013.01)

(58) Field of Classification Search

CPC ..... H01H 21/42

See application file for complete search history.

(56) References Cited

U.S. PATENT DOCUMENTS

| | | | | |
|---|---|---|---|---|
| 2,543,398 | A | 2/1951 | Bohn | |
| 3,550,047 | A | 12/1970 | Gelzheiser | |
| 4,197,519 | A | 4/1980 | Grenier | |
| 5,223,813 | A | 6/1993 | Cambreleng et al. | |
| 5,667,326 | A | 9/1997 | McGaffigan | |
| 5,806,152 | A | 9/1998 | Saitou et al. | |
| 7,864,003 | B2 * | 1/2011 | Yang | H01H 71/46 324/424 |
| 8,476,992 | B2 * | 7/2013 | Yang | H01H 9/20 335/167 |
| 8,749,326 | B2 | 6/2014 | Yang et al. | |
| 8,836,453 | B2 | 9/2014 | Yang et al. | |

(Continued)

FOREIGN PATENT DOCUMENTS

CN 202996737 U 6/2013

OTHER PUBLICATIONS

Petroski, Henry, "Deployable Structures," American Scientist, vol. 92, No. 2, pp. 122-126, Mar. 2004.

(Continued)

*Primary Examiner* — Edwin A. Leon

*Assistant Examiner* — Lheiren Mae A Caroc

(74) *Attorney, Agent, or Firm* — Barnes & Thornburg LLP

(57) ABSTRACT

A blocking member for an actuator having a movable arm for effecting a quick-make feature, includes for example, an elongated member having a first end and a second end, and wherein a portion of said elongated member being configured so that said blocking member disposed in a first position engages a portion of the movable arm of the actuator to restrain movement of the movable arm, and so that said blocking member disposed in a second position disengages from the portion of the movable arm of the actuator to permit movement of the movable arm.

16 Claims, 23 Drawing Sheets

(56) References Cited

U.S. PATENT DOCUMENTS

| | | | |
|---|---|---|---|
| 2014/0043116 | A1 | 2/2014 | Pan et al. |
| 2014/0176293 | A1 | 6/2014 | Melecio et al. |
| 2015/0235794 | A1 | 8/2015 | Rakuff et al. |

OTHER PUBLICATIONS

U.S. Appl. No. 15/075,379, filed Mar. 21, 2016, titled Latch Free Circuit Breakers.
U.S. Appl. No. 15/075,540, filed Mar. 21, 2016, titled Latch Free Actuators.

* cited by examiner

BLOCKING MEMBERS AND CIRCUIT BREAKERS HAVING QUICK-MAKE FEATURE

TECHNICAL FIELD

The present disclosure relates generally to circuit breakers, and more particularly, to blocking members for circuit breakers having a quick-make feature.

BACKGROUND

Circuit breakers are automatically operated electrical switches designed to protect electrical circuits from damage caused by overload or short circuit. A basic function is to detect a fault condition and interrupt current flow.

Typically, in a circuit breaker, the electrical contacts are held closed by a latch mechanism having separate first and second engageable members. Initially, the first member may be positioned to contact the second member to restrain and prevent movement of the second member so that the electrical contacts are maintained in a closed position. The latch mechanism may be triggered by moving or pivoting the first member out of engagement with the second member to allow the second member to move and open the electrical contacts.

In addition, often a circuit breaker includes a "quick-make" feature that allows electrical contacts to be closed quickly from the fully open position to the closed position. The speed of the closing of the electrical contacts is independent of how a handle operated by a user is used to effect the closing of the electrical contacts from the open position, i.e., the contact speed is independent of how fast or slow the handle is moved. Traditional over-center toggle mechanisms achieve a change in linkage orientation with respect to spring tension so that at a certain critical point in the handle movement, a balance of forces will cause the quick rotation of linkages to snap the contacts closed.

SUMMARY

Shortcomings of the prior art are overcome and additional advantages are provided through the provision, in one embodiment, of a blocking member for an actuator having a movable arm for effecting a quick-make feature. The blocking member includes, for example, an elongated member having a first end and a second end, and wherein a portion of the elongated member being configured so that the blocking member disposed in a first position engages a portion of the movable arm of the actuator to restrain movement of the movable arm, and so that the blocking member disposed in a second position disengages from the portion of the movable arm of the actuator to permit movement of the movable arm.

In another embodiment, a circuit breaker having a quick-make feature which includes, for example, a frame, a stationary electrical contact attached to the frame, a movable arm having a first end attachable to the frame and a second end having an electrical contact releasably contactable with the stationary electrical contact, and an actuator mechanism. The actuator mechanism includes a main biasing means operable to apply a first force to move the movable arm in a first direction to open the electrical contacts, a contact biasing means operable to apply a second force to move the movable arm in a second direction to close the electrical contacts, and a blocking member configured so that the blocking member in a first position engages a portion of the movable arm to restrain movement of the movable arm by the main biasing means and maintain the electrical contacts open, and so that the blocking member disposed in a second position disengages from the portion of the movable arm to permit movement of the movable arm by the contact biasing means to close the electrical contacts.

In another embodiment, a method for moving a movable arm to effect a quick-make feature. The method includes, for example, engaging the movable arm with a blocking member to restrain movement of the movable arm in a first direction, and disengaging the movable arm from the blocking member to allow movement of the movable arm in the first direction.

In another embodiment, a method for actuating a circuit breaker for opening and closing electrical contacts. The method includes, for example, engaging a movable arm with a blocking member to restrain movement of the movable arm in a first direction and maintain the electrical contacts open, and disengaging the blocking member from the movable arm to allow movement of the movable arm in the first direction to close the electrical contacts.

DRAWINGS

The foregoing and other features, aspects and advantages of this disclosure will become apparent from the following detailed description of the various aspects of the disclosure taken in conjunction with the accompanying drawings, wherein.

Figure 1:
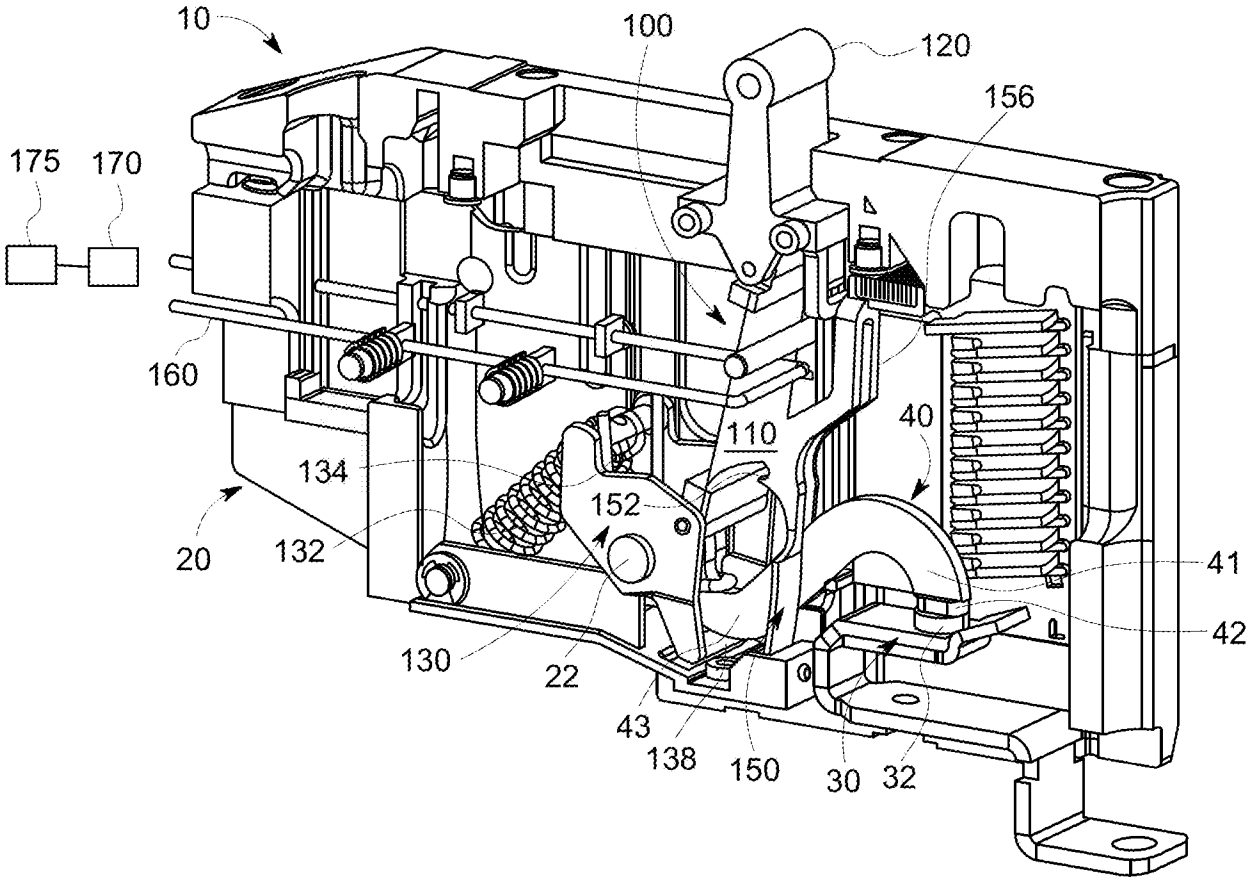
FIG. 1 is a perspective view of a circuit breaker, portions cut-away, according to an embodiment of the present disclosure disposed on an ON-state or position.
Figure 15:
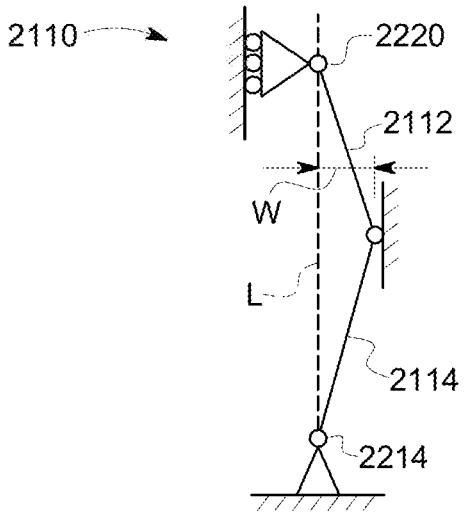
FIG. 15 is a diagrammatic illustration of a yieldable support according to another embodiment of the present disclosure.
Figure 16:
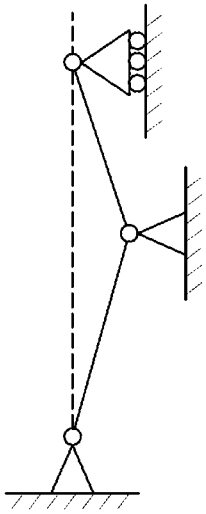
Figure 17:
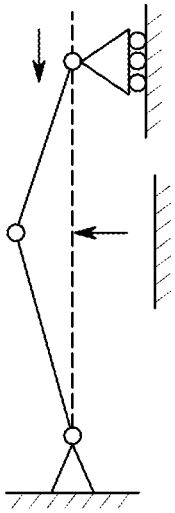
Figure 18:
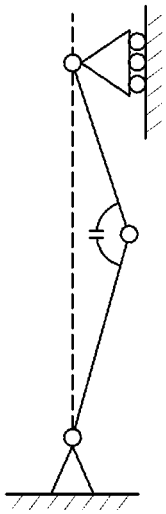
Figure 19:
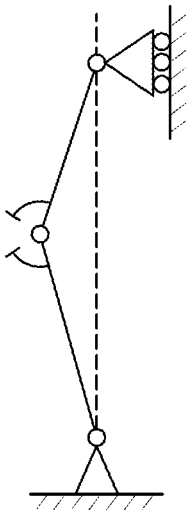
Figure 20:
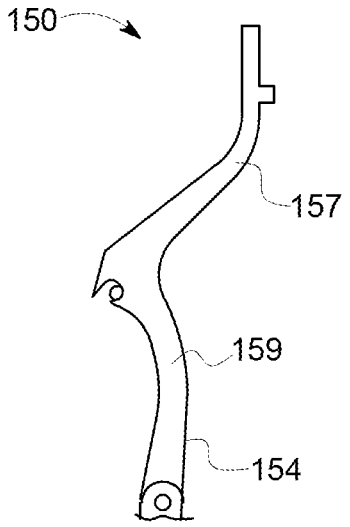
Figure 21:
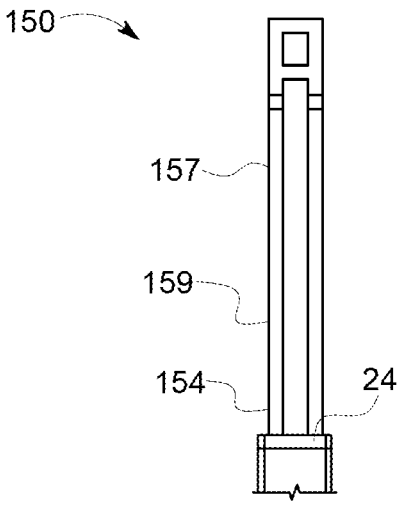
Figure 22:
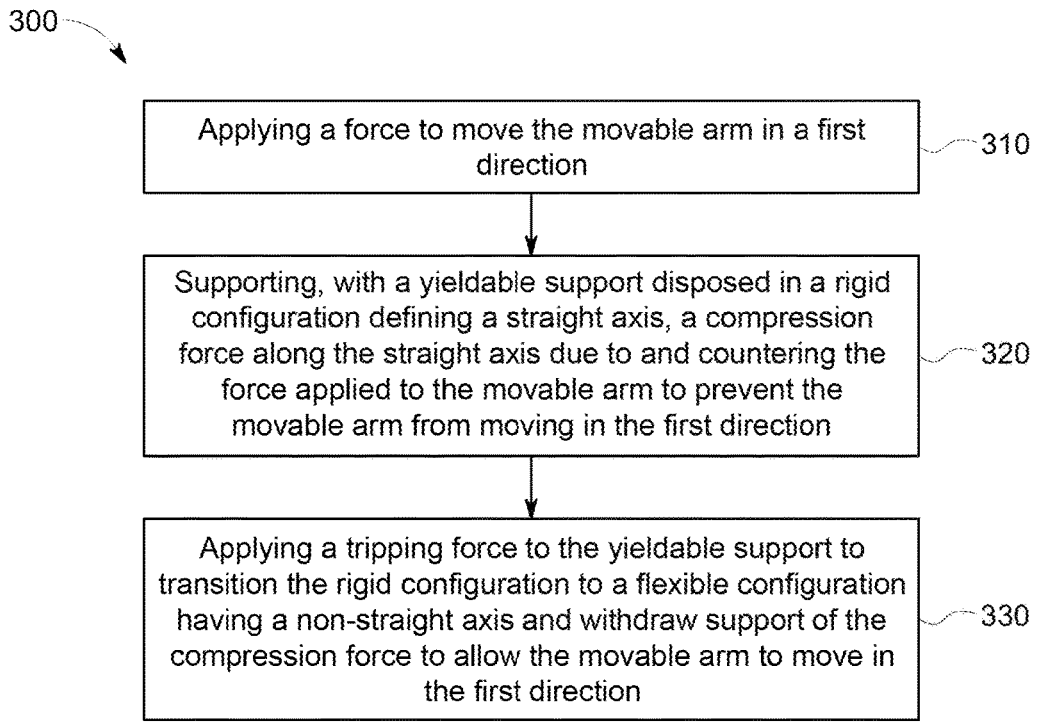
Figure 23:
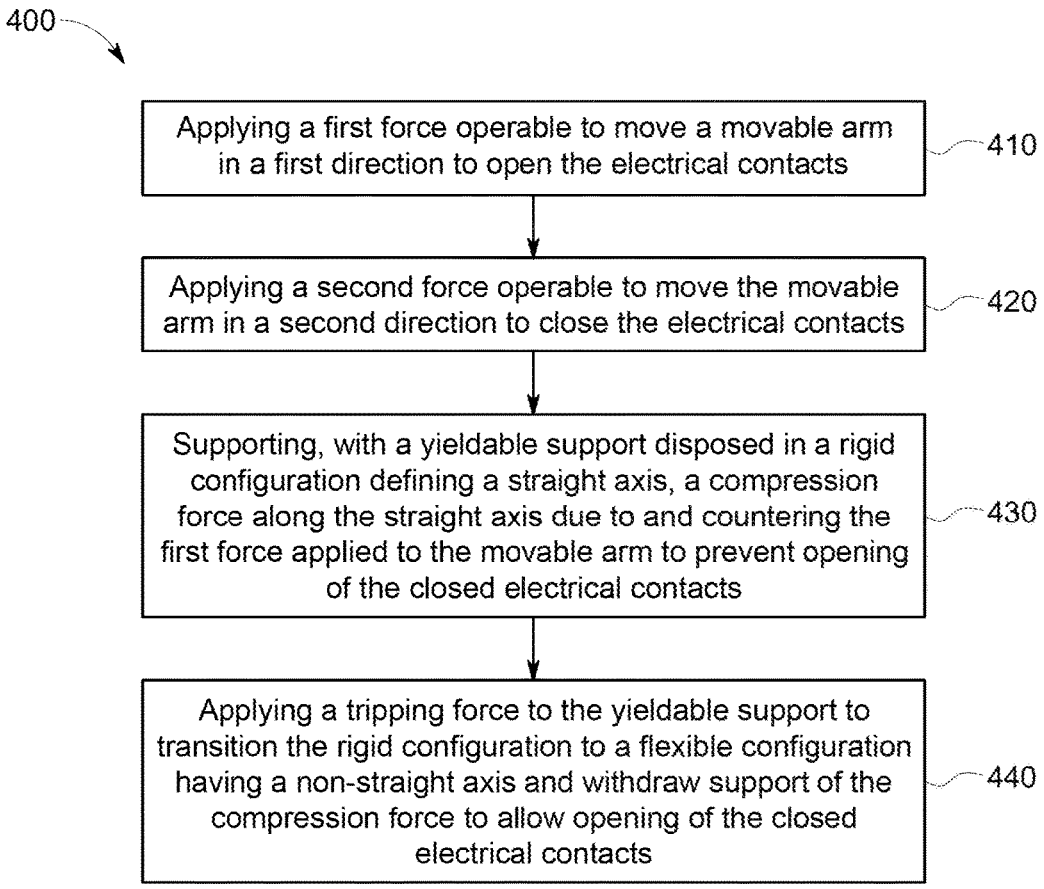
Figure 24:
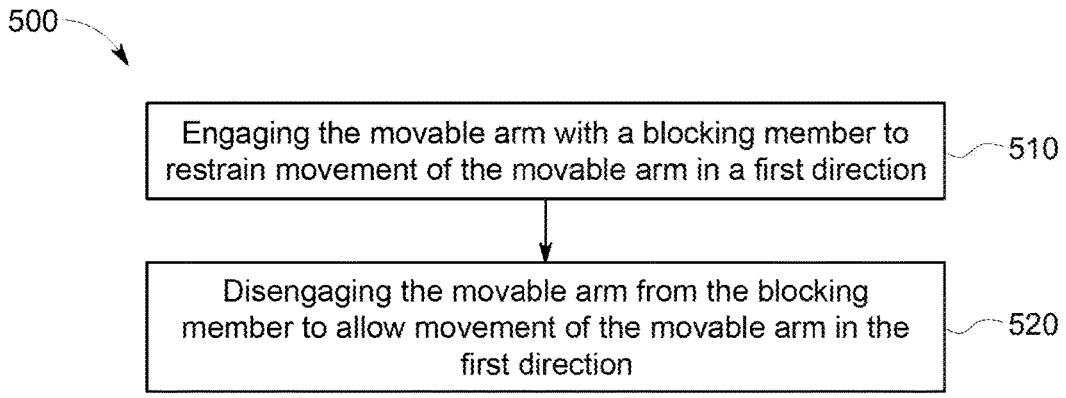
Figure 25:
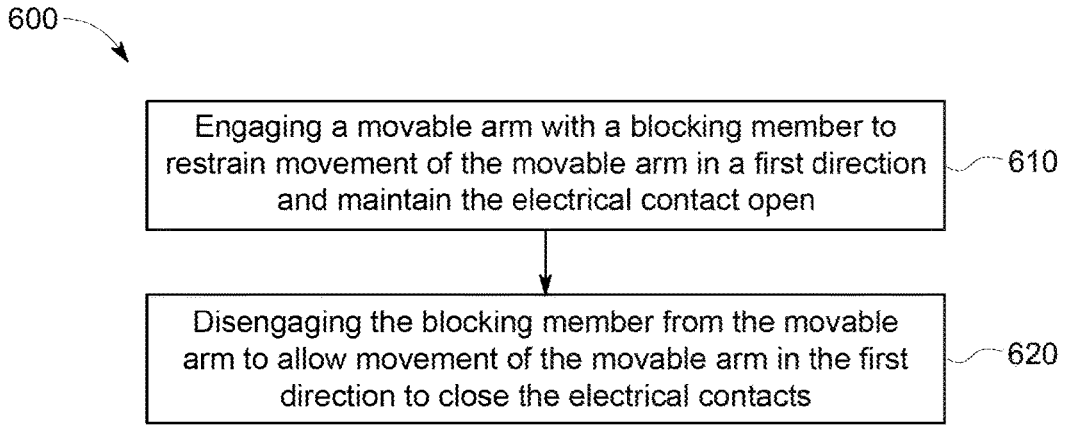
Figure 26:
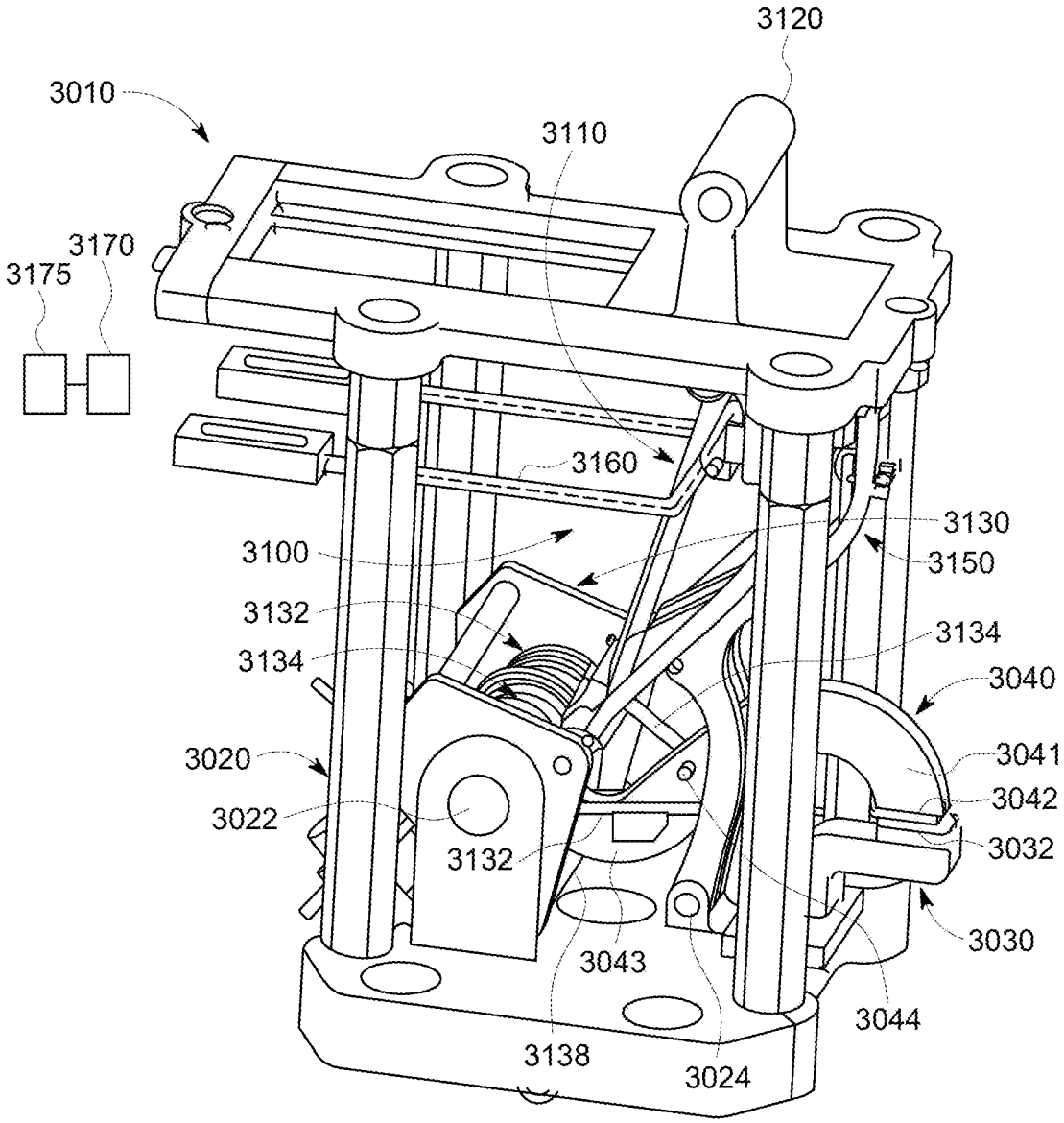
Figure 27:
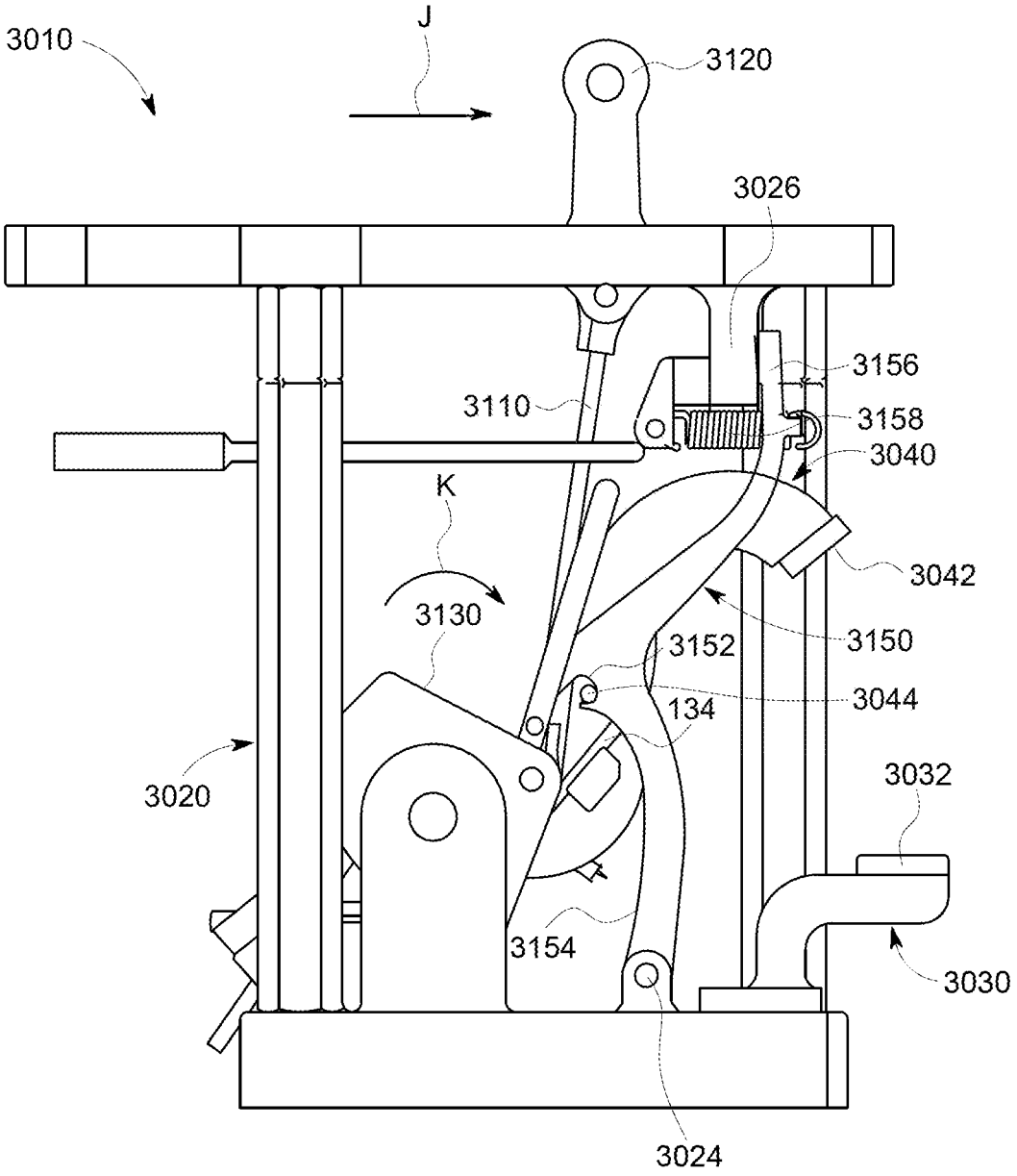
Figure 28:
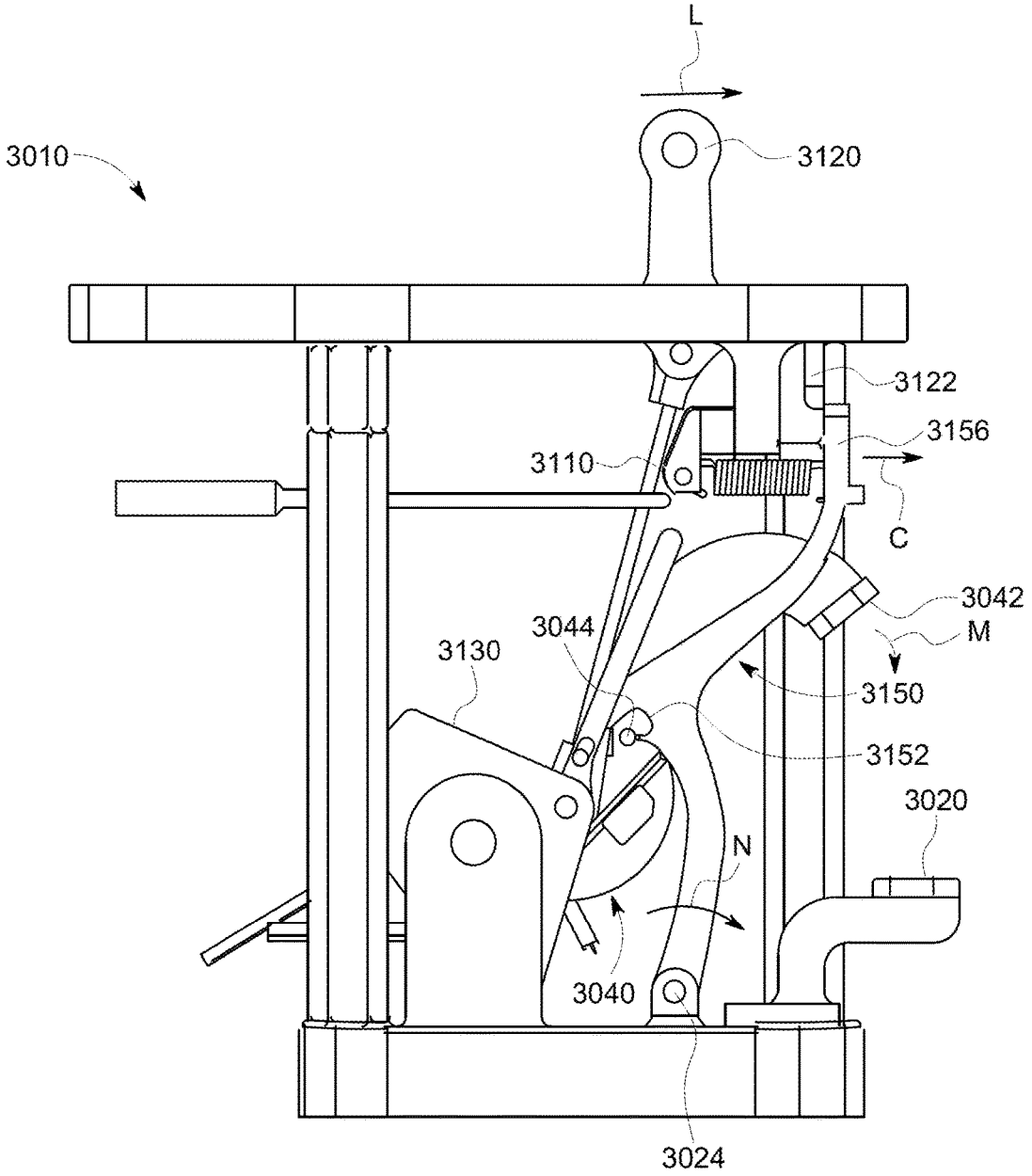
Figure 29:
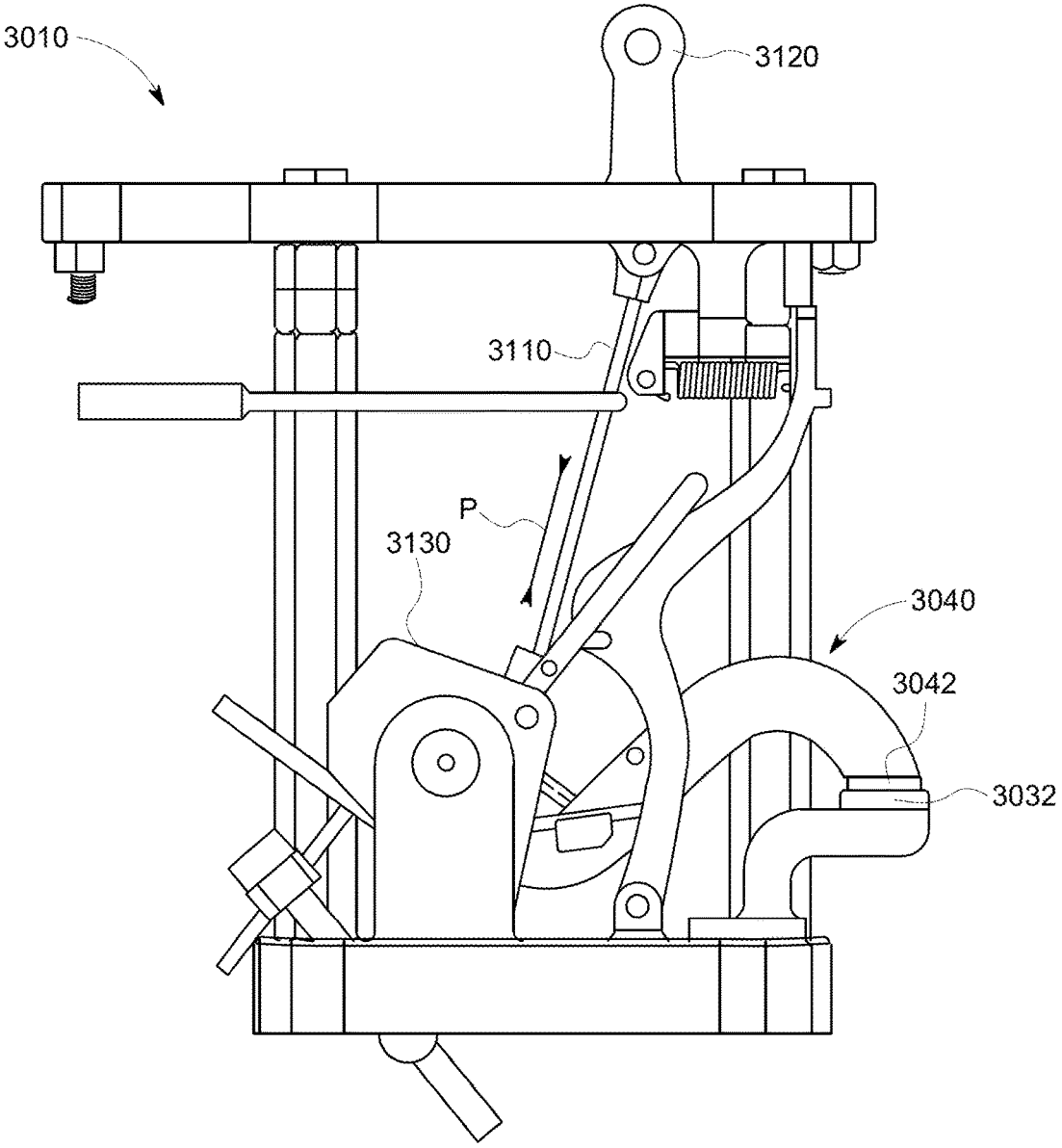
Figure 30:
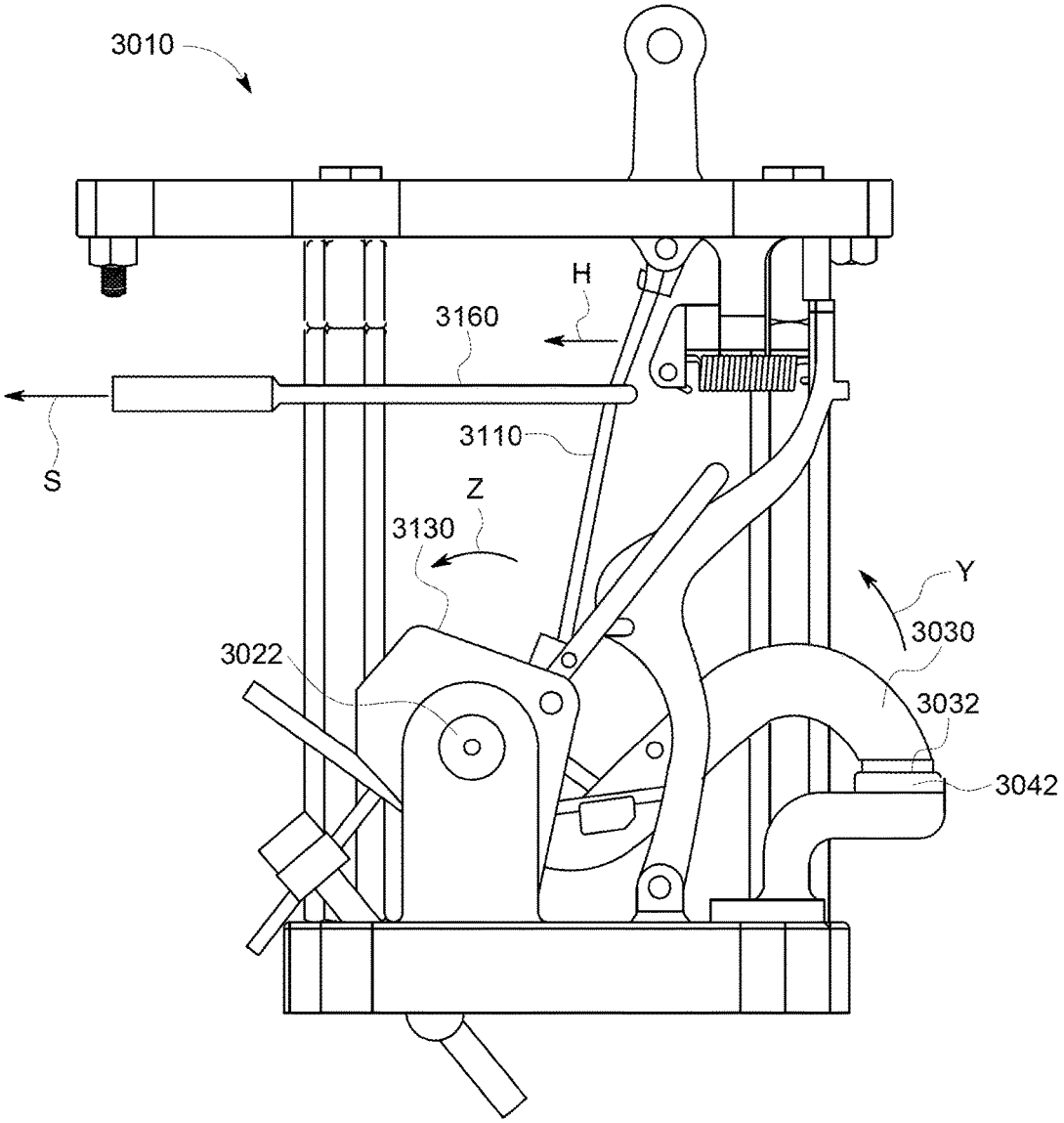
Figure 31:
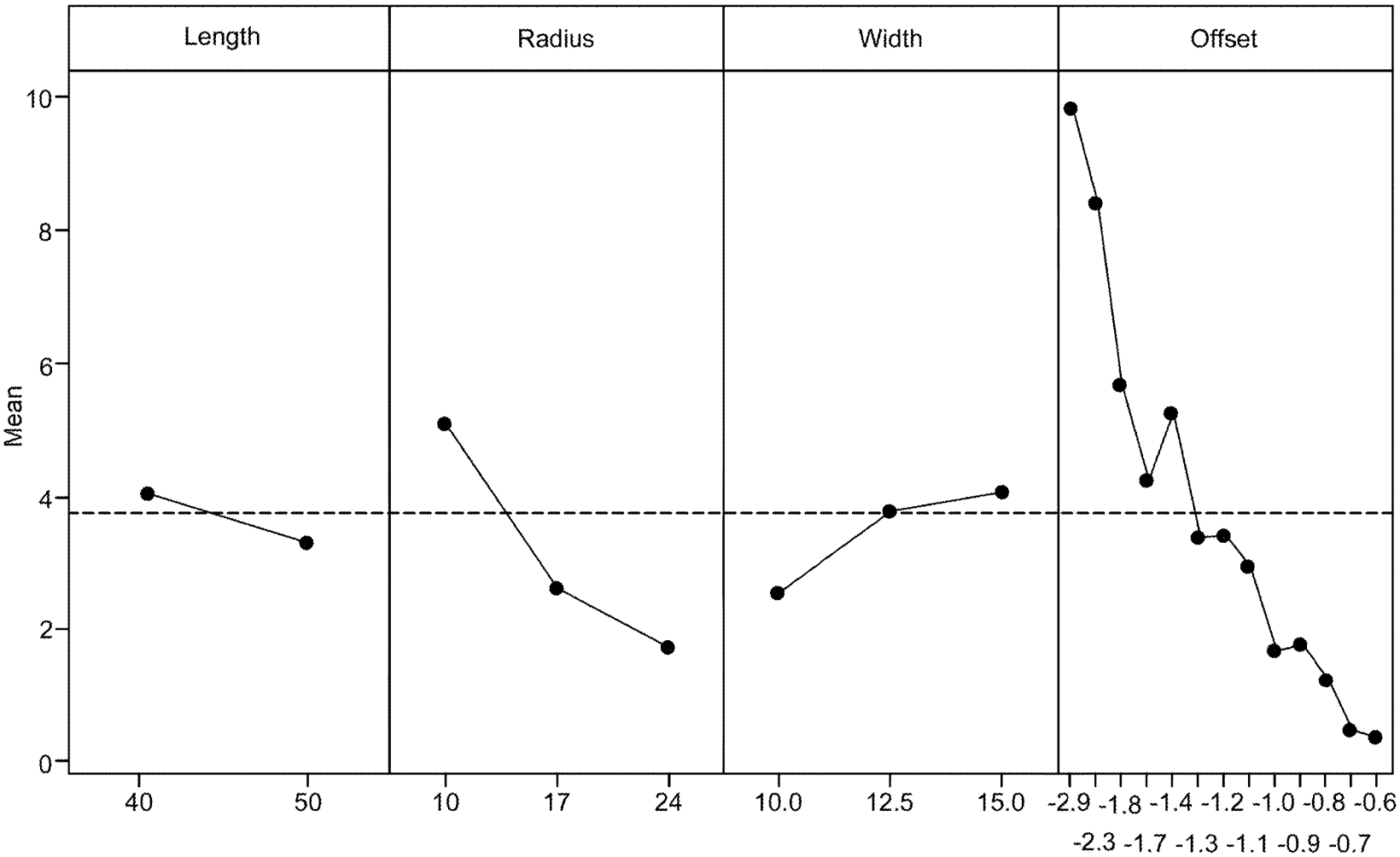
Figure 32:
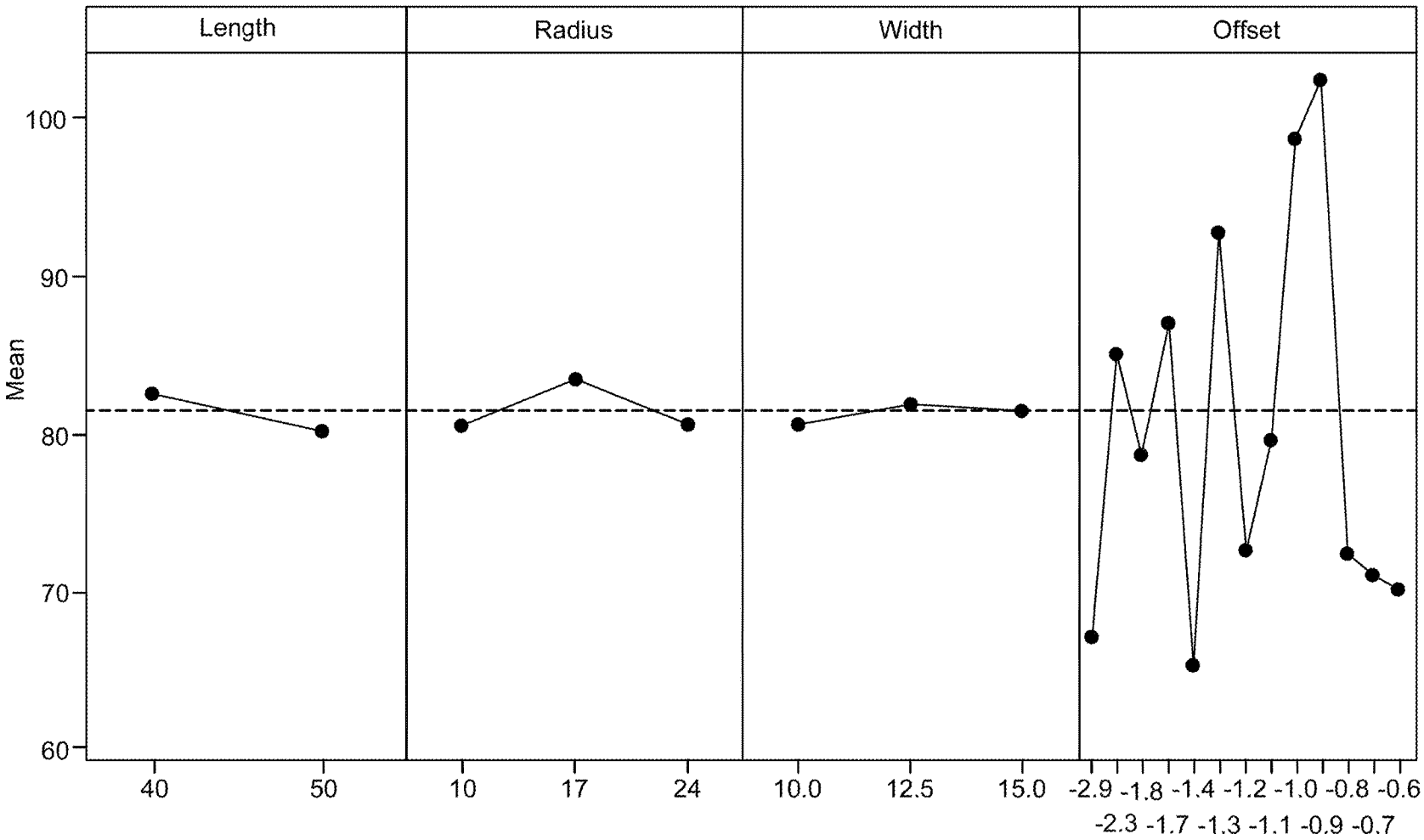

FIGS. 16 and 17 diagrammatically illustrate a transition from a rigid mode to a flexible mode according to an embodiment of the yieldable support of FIG. 15 where the inner revolute is restrained in the rigid mode;

FIGS. 18 and 19 diagrammatically illustrate a transition from a rigid mode to a flexible mode according to an embodiment of the yieldable support of FIG. 15 where the inner revolute is restrained in the rigid mode by features part of the links mutually contact and limit rotation;

FIG. 20 is an elevational view of the blocking member of the circuit breaker of FIG. 1;

FIG. 21 a side elevational view of the blocking member of FIG. 20;

FIG. 22 a flowchart of a method for actuating a movable arm according to an embodiment of the present disclosure;

FIG. 23 a flowchart of a method for actuating a circuit breaker to open electrical contacts according to an embodiment of the present disclosure;

FIG. 24 a flowchart of a method moving a movable arm to effect a quick-make feature according to an embodiment of the present disclosure;

FIG. 25 a flowchart of a method for actuating a circuit breaker for opening and closing electrical contacts according to an embodiment of the present disclosure;

FIG. 26 is a perspective view of a circuit breaker according to an embodiment of the present disclosure;

FIG. 27 is a side elevational view, portions cut-away, of the circuit breaker of FIG. 26 disposed in an open OFF position;

FIG. 28 is a side elevational view, portions cut-away, of the circuit breaker of FIG. 26 illustrating a beginning of a transition from an open OFF position to a closed position;

FIG. 29 is a side elevational view, portions cut-away, of the circuit breaker of FIG. 26 disposed in a closed ON position;

FIG. 30 is a side elevational view, portions cut-away, of the circuit breaker of FIG. 26 with a tripping force applied to the yieldable support to begin the transition from a closed position to an open position;

FIG. 31 is a main effects plot for horizontal load;

FIG. 32 is a main effects plot for buckling load; and

Figure 33:
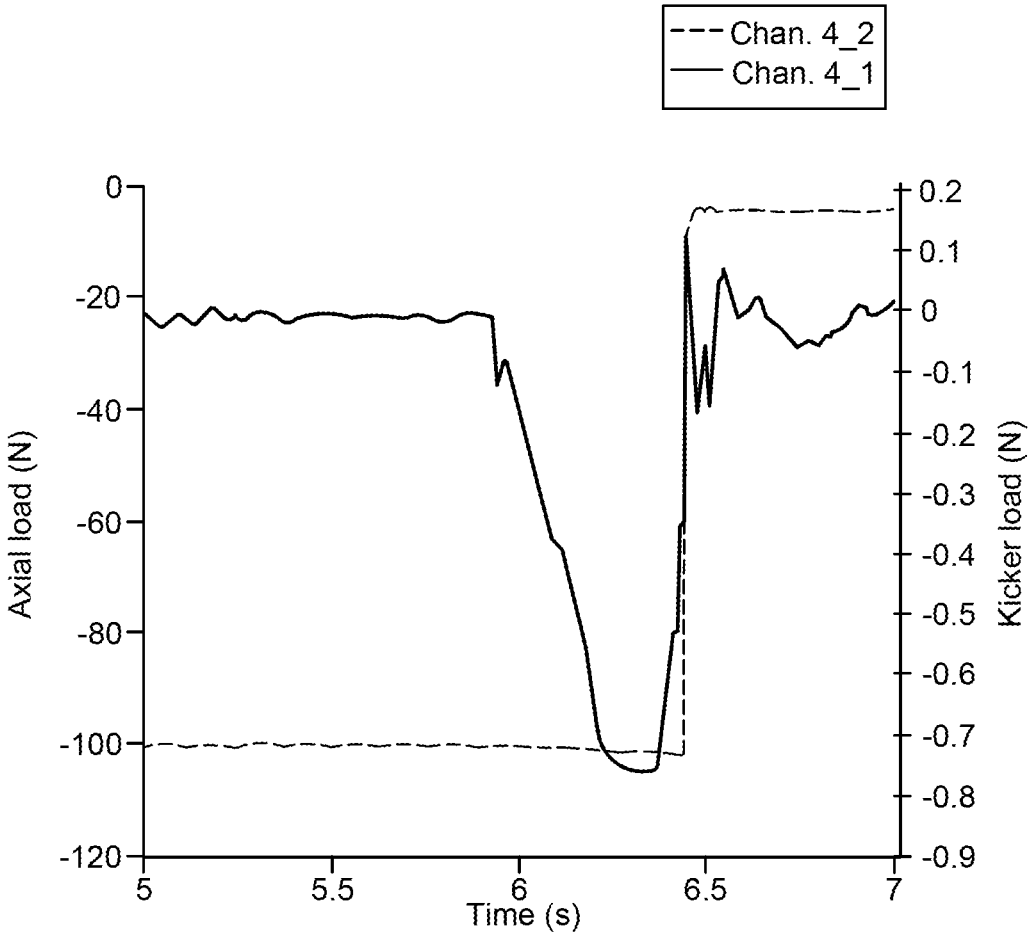

FIG. 33 is a main effects plot for axial and kicker at buckle.

DETAILED DESCRIPTION

Embodiments of the present disclosure and certain features, advantages, and details thereof, are explained more fully below with reference to the non-limiting examples illustrated in the accompanying drawings. Descriptions of well-known materials, processing techniques, etc., are omitted so as not to unnecessarily obscure the disclosure in detail. It should be understood, however, that the detailed description and the specific examples, while indicating embodiments of the present disclosure, are given by way of illustration only, and not by way of limitation. Various substitutions, modifications, additions, and/or arrangements, within the spirit and/or scope of the underlying inventive concepts will be apparent to those skilled in the art from this disclosure.

The present disclosure in some embodiments employ a yieldable support such as a flexure member or plurality of rigid links having a rigid configuration or mode for supporting a force in compression, and which upon tripping or buckling transitions to a flexible configuration or compliant mode. Such a technique may be employed in an actuator/trip mechanisms for triggering systems such as circuit breakers. A blocking member may also be provided for temporarily limiting movement of such an actuator/trip mechanism thereby making the actuator/trip mechanism a quick-make actuator/trip mechanism.

As will be appreciated from the discussion below, the technique of the present disclosure may provide an actuator and circuit breaker operable for maintaining the electrical contacts in a closed position and for opening the electrical contacts which may provide a simplified mechanism with less parts, at less costs, and possibly more easily manufactured compared to an actuator and circuit breaker employing a latch mechanism for maintaining the electrical contacts in a closed position and for opening the electrical contacts. Such a technique of the present disclosure may provide circuit breaker having enhanced performance characteristics compared to conventional circuit breaker employing a latching mechanism.

FIG. 1 illustrates an embodiment of a circuit breaker 10 such as a latch-free circuit breaker according to an embodiment of the present disclosure. For example, as shown in FIG. 1, circuit breaker 10 is disposed in an ON-state or position. The embodiment of FIG. 1 is used to illustrate features of the present disclosure, however it will be appreciated that the present disclosure is not to be limited to the configuration of the circuit breaker illustrated in FIG. 1.

Circuit breaker 10 generally includes a frame 20, a stationary contact arm 30, a movable contact arm 40, and an actuator/trigger mechanism 100. Actuator/trigger mechanism 100 may generally include a yieldable support 110, a handle 120, a crank 130, a blocking member 150, and a trip bar 160. As described in greater detail below, the yieldable support may have a rigid configuration defining a straight axis and a flexible configuration defining a non-straight axis. The yieldable support is operable in the rigid configuration to support a compression force along the straight axis for use in charging or energizing the circuit breaker and maintaining the circuit breaker in a closed configuration. The yieldable support is operable in the flexible configuration or resilient bent configuration to allow the circuit breaker to quickly transition to an open configuration.

As shown in FIG. 1, movable contact arm 40 includes a first end 41 having a movable contact 42, and a second end 43 pivotally attached to frame 20 and rotatable about a pin 22. Stationary contact arm 30 includes a stationary contact 32. Yieldable support 110 includes an upper end operably attachable to handle 120, and a lower end operably attachable to crank 130. Crank 130 is pivotable about pin 22 and includes two sets of biasing means such as springs, for example, a first biasing means such as a main spring 132 and a second biasing means such as a contact spring 134 (further shown in FIG. 2).

Figure 3:
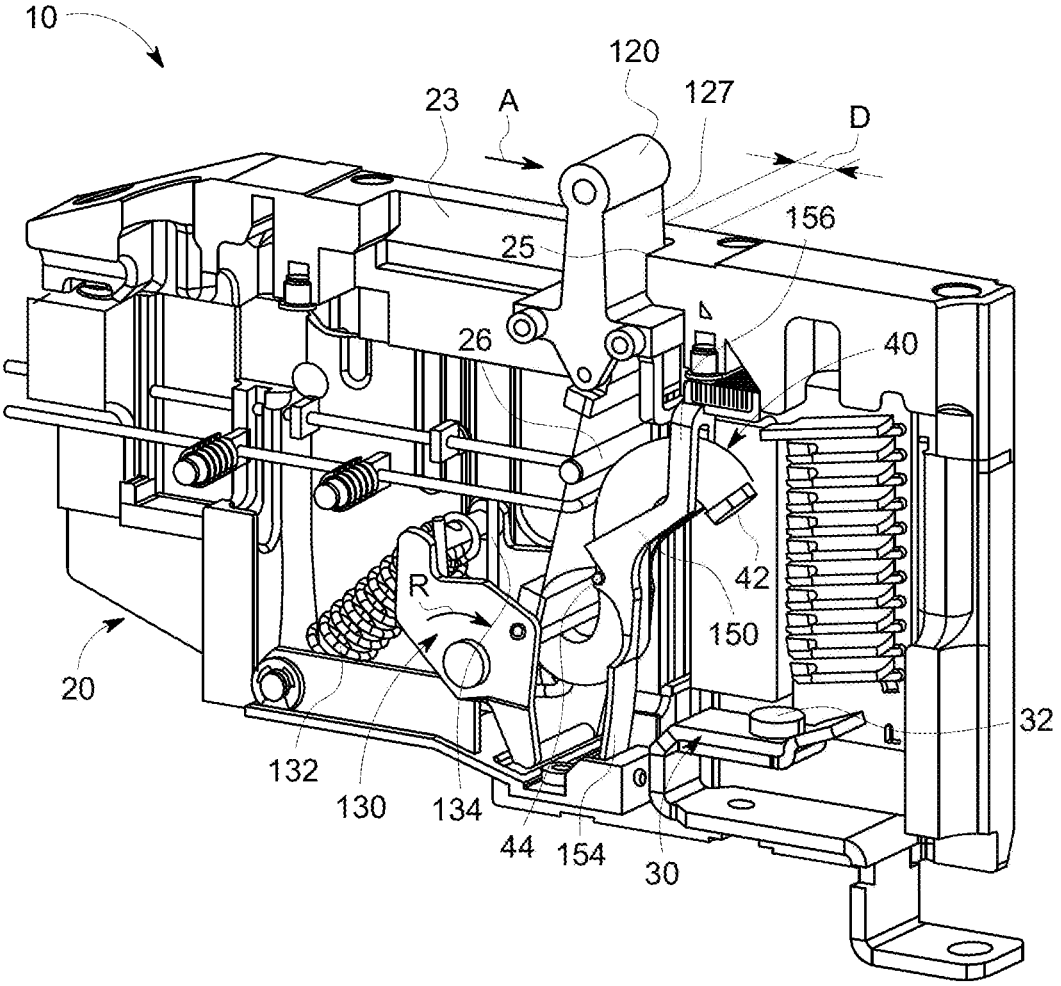
FIGS. 3-5 are perspective and side elevational views, portions cut-away, of the circuit breaker of FIG. 1 illustrating a transition from an open OFF-state or position to a closed ON-state or position.
Figure 4:
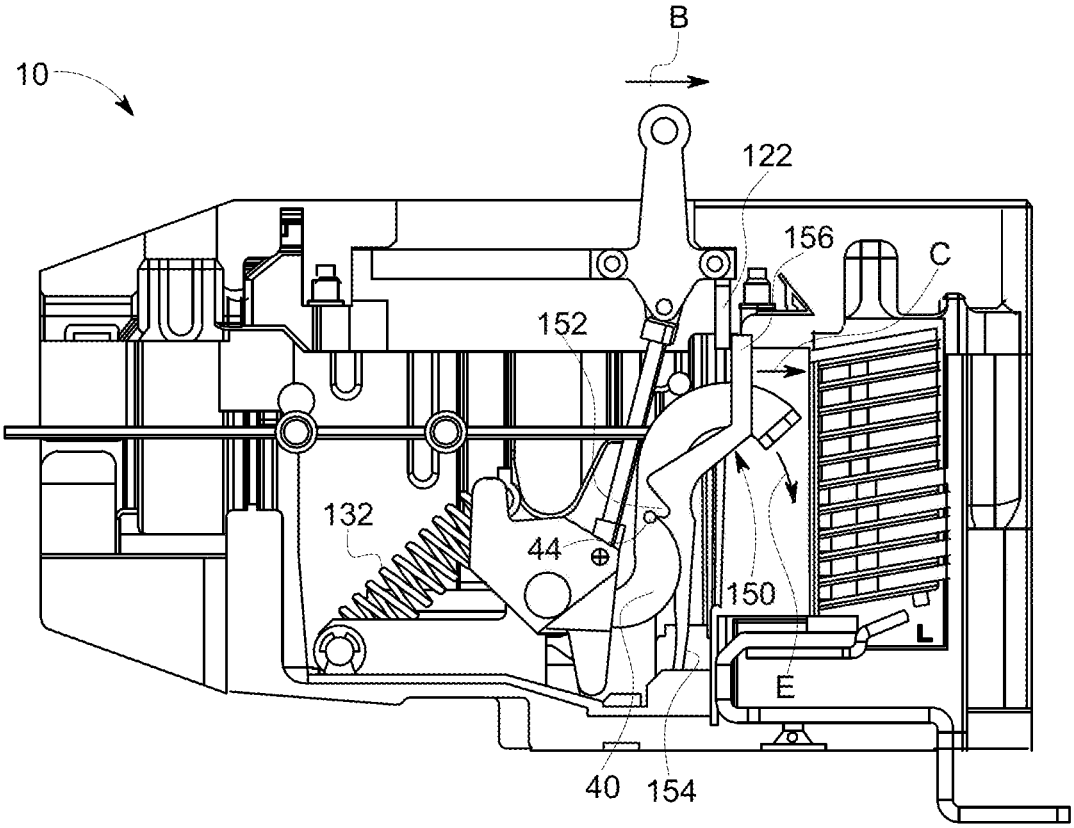
Figure 5:
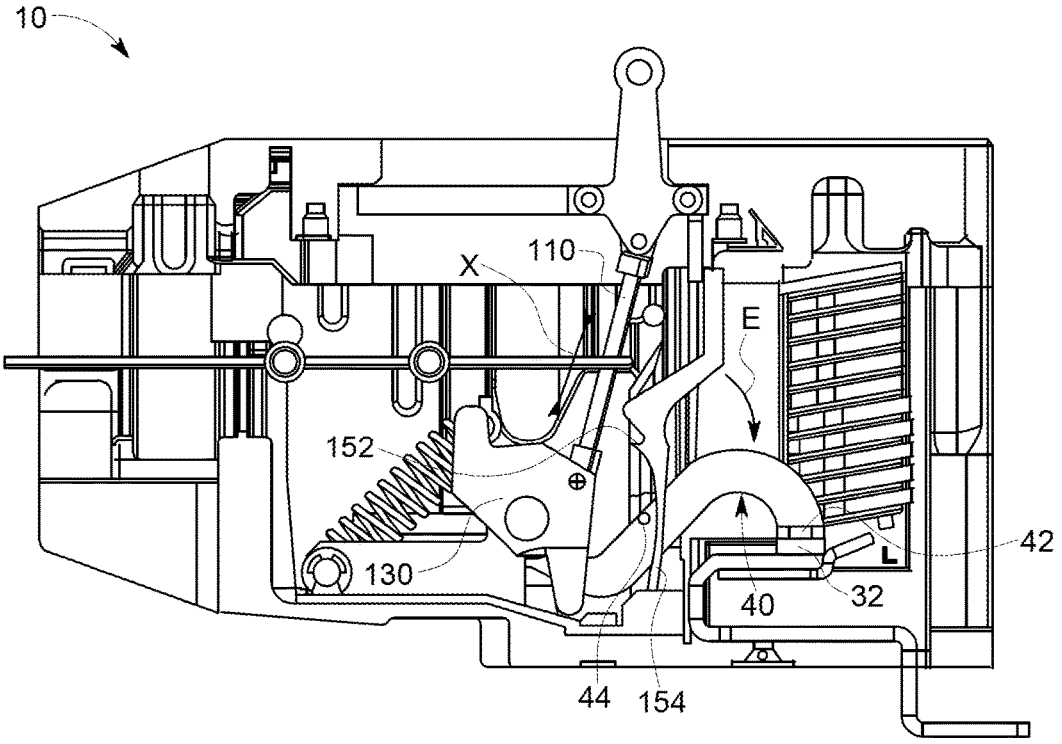

FIGS. 2-5 illustrate the operation of moving circuit breaker 10 from an OFF-state or position to an ON-state or position and which provides a quick-make wherein the speed of the closing of the electrical contacts is made independent of how fast the handle is moved. For example, FIGS. 2-5 illustrate circuit breaker 10 disposed in an open OFF position (FIG. 2), initial movement of the handle to effect the ON position (FIG. 3), a beginning of a transition from an open OFF position to a closed ON position (FIG. 4), and in a closed ON position (FIG. 5).

Figure 2:
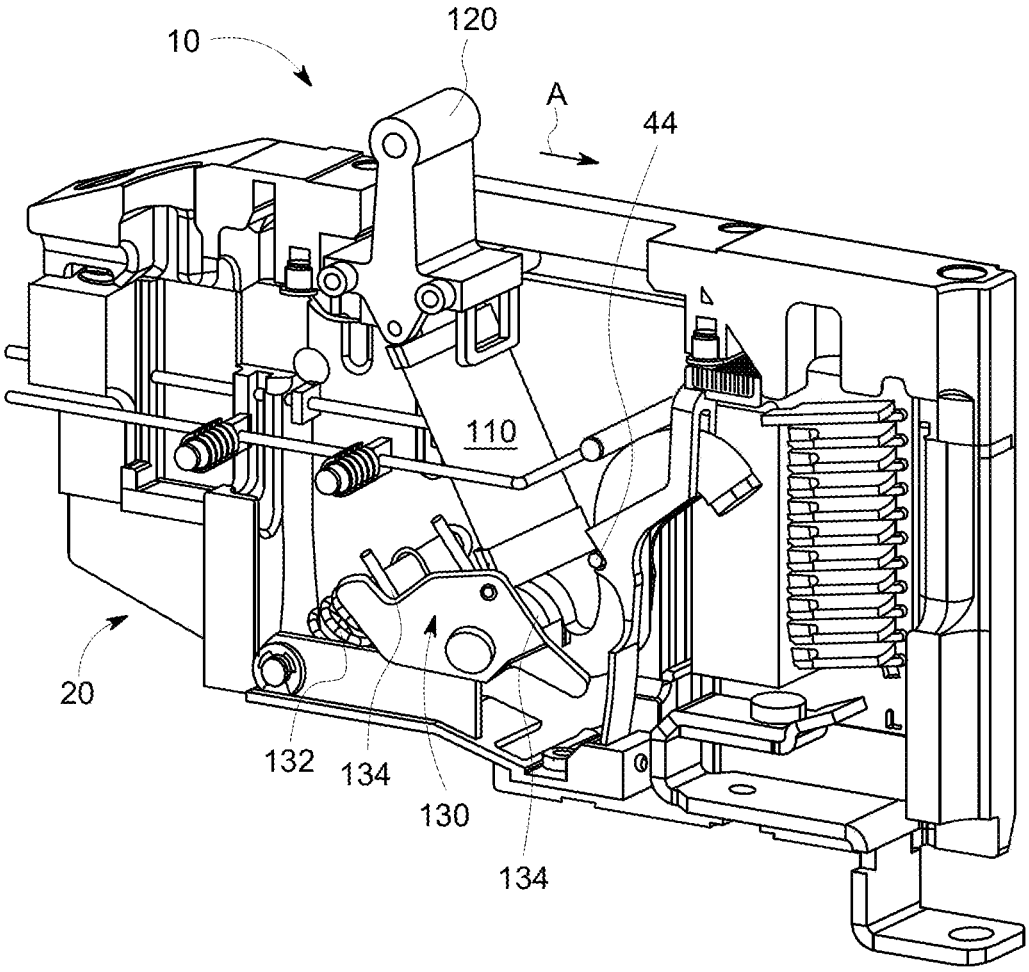
FIG. 2 is a perspective view, portions cut-away, of the circuit breaker of FIG. 1 disposed in an open OFF position.

Initially as shown in FIG. 2, with circuit breaker 10 disposed in an open OFF position, handle 120 is disposed in a left most position. Handle 120 is moved from the left most position in the direction of arrow A towards the illustrated position shown in FIG. 3. The movement of the handle from left to right is transmitted via yieldable support 110 in a rigid configuration to cause a clockwise rotation of crank 130 in the direction of arrow R. During this operation, the yieldable support 110 remains rigid and does not flex. As crank 130 is rotated clockwise, the two sets of springs, main spring 132 is stretched and contact spring 134 (best shown in FIGS. 1 and 2) is wound up to increase their stored energy. Main spring 132 acts to resist the handle movement, and in the absence of the reaction provided by yieldable support 110, will rotate crank 130 counterclockwise as described below. Contact spring 134 acts between movable contact arm 40 and crank 130 (or alternatively between a movable contact arm and a base) and serves to provide a contact force between movable contact 42 of movable contact arm 40 and stationary contact 32 of stationary arm 30 when in a closed position. The contact force is operable to reduce electrical contact resistance and any concomitant rise in temperature.

In addition, as shown in FIGS. 2 and 3, movable contact arm 40 exhibits a full open OFF position with a large gap between electrical contacts 32 and 42. Both sets of springs in crank 130, main spring 132 and contact spring 134, are charged with elastic energy resulting in a moment that is acting to move movable contact arm 40 downwardly, but any downward movement of movable contact arm is prevented by a stop 44 of movable contact arm 40 resting in, engaging, and being restrained in a saddle or cutout 152 (best shown in FIGS. 1 and 4) in blocking member 150.

As further illustrated in FIG. 3, blocking member 150 includes a lower end 154 operably fixedly attached to a base of frame 20, and an upper end 156 operably engageable with a stop bar 26 attached to frame 20. For example, lower end 154 of blocking member 150 being fixedly restrained normally biases upper end 156 of blocking member 150 toward and against stop bar 26, e.g., provides a restoring force to upper end 156 of blocking member 150. As noted above, blocking member 150 provides an additional point of contact and restraint for movable contact arm 40. For example, movable contact arm 40 includes stop 44 such as projections extending outwardly from movable contact arm 40 (FIG. 3 illustrating one of the projections, the other projection being disposed on the opposite side of movable arm 40). Stop 44 is releasable engageable and disposable in saddle or cutout 152 in blocking member 150 (FIG. 3 illustrating one of the saddle or cutout 152, the other saddle or cutout 152 being disposed on the opposite side of blocking member 150). Depending on the position of blocking member 150, saddle or cutout 152 restrains stop 44 of movable contact arm 40 from movement, and in effect restrains movable contact arm 40 from moving from an open OFF position to a closed ON position.

As described below, blocking member 150 along with yieldable support 110, movable contact arm 40, and crank 130 allows circuit breaker 10 facilitate a quick-make feature where the contacts may be closed quickly. For example, the electrical contacts may be closed on the order of a few milliseconds from the fully open position to the closed position. As noted in FIG. 3, handle 120 is movable in a slot 23 defined by frame 20 with a side 127 of handle 120 spaced a distance D from the front edge 25 of slot 23.

With reference to FIG. 4, to close the electrical contacts, handle 120 is further moved to the right in the direction of arrow B. A downward projection 122 attached to or part of handle 120 engages and begins to force upper end 156 of blocking member 150 to the right in the direction of arrow C and pivot and/or flex blocking member 150 about the lower fixed end 154. As handle 120 moves to the fully forward position, upper end 156 of blocking arm 150 moves forward, cutout 152 moves to the right with stop 44 of blocking arm 40 riding along the lower inside portion of cutout 152 until stop 44 is no longer restrained in cutout 152 as shown in FIG. 4.

Once stop 44 is no longer restrained in cutout 152, as shown in FIG. 4, movable contact arm 40 will be released and allowed to rotate. In particular, the force exerted by crank 130 (and in particular, by spring 134 (FIGS. 1 and 3)) on movable contact arm 40 (not the force applied by the operator to the handle) causes movable contact arm 40 to pivot and/or flex about lower fixed end 154 so that movable contact arm 40 moves downwardly in the direction of arrow E until movable electrical contact 42 contacts and engages stationary contact 32 so that circuit breaker 10 is disposed in a closed ON position as shown in FIG. 5. The final movement of the contact arm may be accomplished quickly, on the order of a few milliseconds. It will be appreciated that with the components thus described, the speed at which the contact gap is closed is independent on the speed that the handle is moved from the OFF configuration to the ON configuration. For example, the electrical contact may be closed in about 2 milliseconds to about 10 milliseconds.

From the present description and with reference to FIGS. 2-5, it will be appreciated that in moving the handle from a fully open OFF position (FIG. 2) to the closed ON position (FIG. 5), crank 130 will move in a clockwise rotation, due to movement of handle 120 being transferred via yieldable support 110. Further, main spring 132 resists this movement and increases its stored energy. Contact spring 134 (FIGS. 2 and 3) forces movable contact arm 40 to either come to rest on cross beam 138 (FIG. 1) of crank 130 or stationary contact 30, which is dependent on the position of the crank. For example, if crank 130 is at or near the full clockwise position, then movable electrical contact 42 will rest on stationary contact 32 (e.g., a pre-defined or predetermined clearance keeps the components from contacting each other), and if the crank is in any other position, a lower portion of movable contact arm 40 will rests on cross beam 138 (FIG. 1) of crank 130. It will also be appreciated that the reaction forces on handle 120 via the flexure-crank-main spring assemblage may serve to keep handle 120 in either an OFF or an ON position once placed there by an operator.

Figure 6:
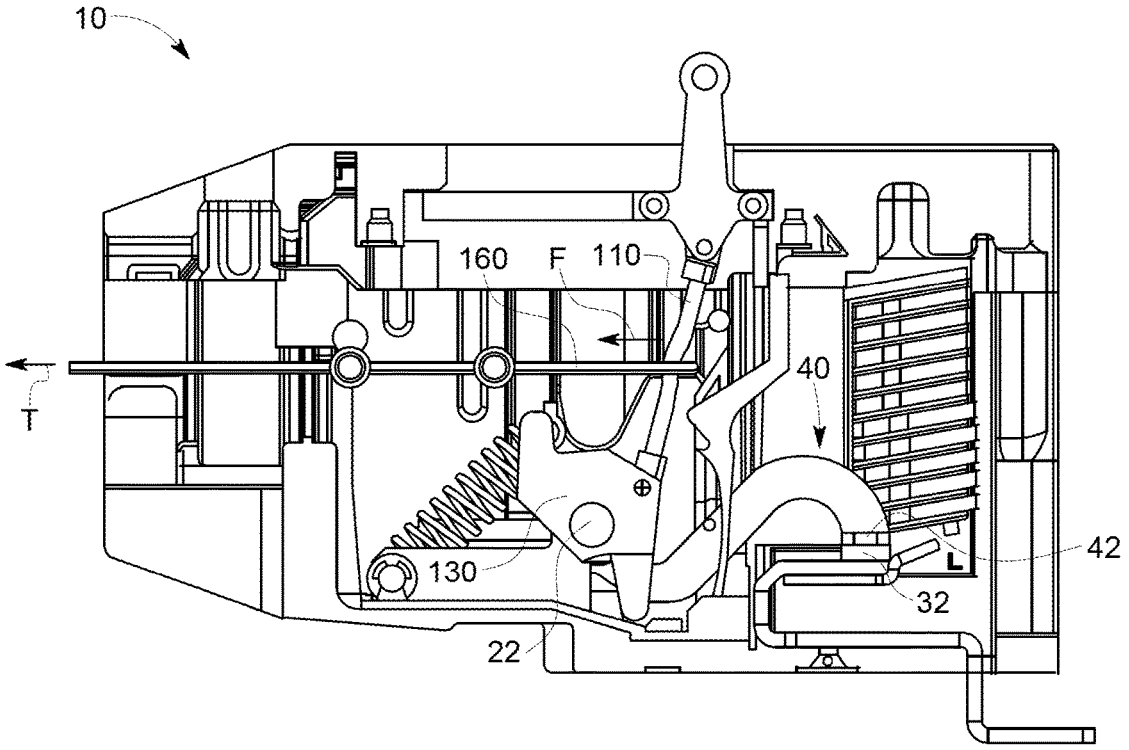
FIG. 6 is a side elevational view, portions cut-away, of the circuit breaker of FIG. 1 with a tripping force applied to the yieldable support to begin the transition from a closed position to an open position.
Figure 7:
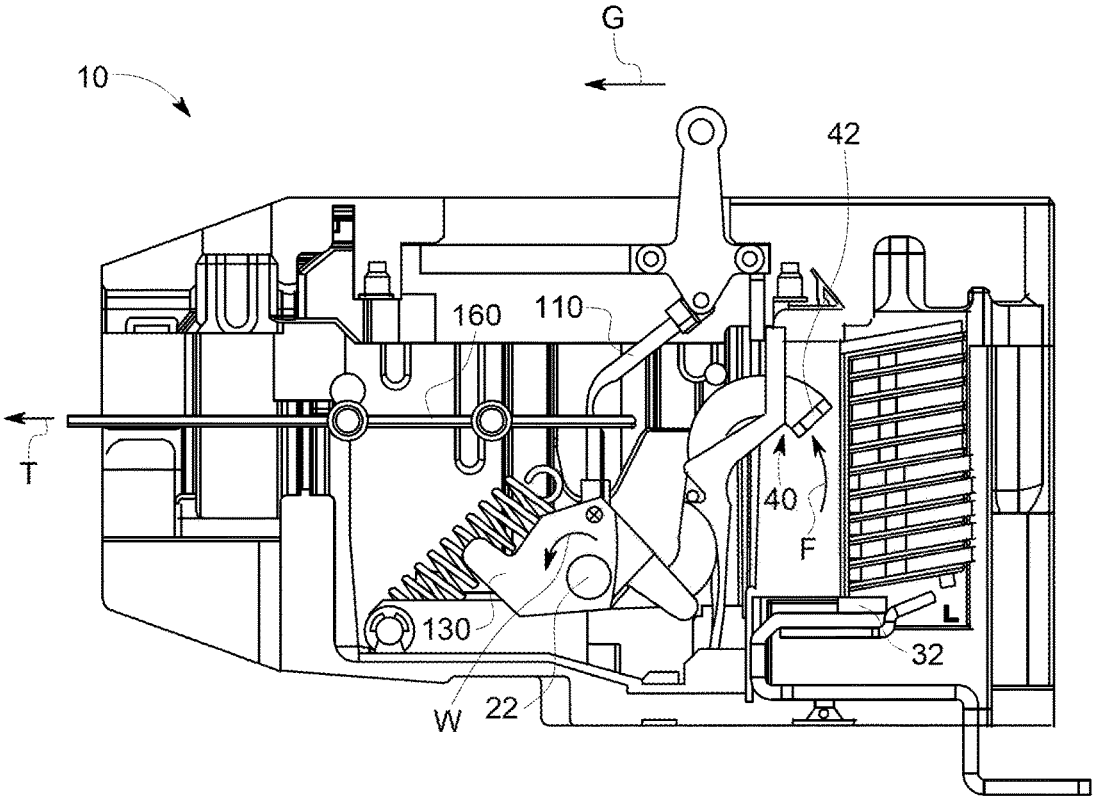
FIG. 7 is a side elevational view of the circuit breaker of FIG. 1 with the circuit breaker in an open position after being tripped and transitioning from the closed position to an open position.

FIGS. 5-7 illustrate the operation of circuit breaker 10 transitioning from the secure ON-state or position to an OFF-state or position and which provides a quick-break wherein the speed of the opening of the electrical contacts occurs quickly. For example, FIG. 5 illustrates circuit breaker 10 initially disposed in a secured closed ON position, FIG. 6 illustrates a tripping or beginning of a transition from a closed ON position to an open OFF position, and FIG. 6 illustrates a tripped fully open OFF position.

As described in greater detail below, the latch-free circuit breaker may have a quick-break feature provided generally by yieldable support 110 operable in, for example, two configurations or modes, a rigid configuration or rigid mode and a flexible configuration or compliant mode. As noted above and as shown in FIG. 5, yieldable support 110 is operable for carrying an axial load between two pivot points in the rigid mode, and supporting the axial load for an extended period of time. For example, yieldable support 110 is operable for carrying an axial load X to maintain crank 130 in position and movable arm in a closed position.

In addition, as shown in FIGS. 6 and 7, yieldable support 110 may be tripped by trip bar 160 moving in the direction of arrow T to apply a direct force F (FIG. 6) on yieldable support 110 along it length to deform, buckle, or bend yieldable support 110 so that yieldable support 110 transitions to a compliant mode, which offers little resistance to the axial load maintaining crank 130 in a clockwise position and movable arm 40 in a closed position. Upon yieldable support 110 being tripped and transitioning to the compliant or flexible mode offering reduced or little axial resistance, crank 130 rotates counter-clockwise in the direction of arrow W (FIG. 7) about pin 22, and movable contact arm 40 pivots about pivot 22 in the direction of arrow F (FIG. 7) to quickly open electrical contacts 32 and 42.

For example, if crank 130 is in its counterclockwise position as shown FIG. 7, the contact spring will drive movable contact arm 40 to rest on cross beam 138 (FIG. 1) with some force. To reset the circuit breaker, handle 120 is move to the left in the direction of arrow G which causes yieldable support return to its rigid configuration as shown in FIG. 2. For example, as described below, yieldable support may have a curved cross-section so that when handle 120 is moved to the left, the yieldable support snaps back into in to its normal rigid configuration. It will be appreciated that other cross-sections such as round or oval and employing suitable materials and stiffness, may provide a yieldable support which is elastically bendable and which snaps back to its normal rigid configuration after being bent.

With reference again to FIG. 1, an electromagnetic solenoid 170 may be operably connected to trigger the movement of trip bar 160 which transitions yieldable support 110 from a rigid mode (FIG. 5) to a compliant mode (FIGS. 6 and 7) and releases moveable contact arm 40 from contact with stationary arm 30. Solenoid 170 may controlled via an electronic unit or controller 175, which performs diagnostic tests prior to effecting the tripping of the circuit breaker. While the description is made to a single-pole breaker, it will be appreciated that the technique of the present disclosure may be applied to 2, 3, or more pole circuit breaker.

From the present description, it will be appreciated that the yieldable support can be readily changed from rigid to compliant with a small energy input in the form of a force, torque, thermal energy, electromagnetic energy, pressure, etc., and likewise the yieldable support can be reset from the compliant mode to the rigid mode with little effort. The yieldable support may be cycled reliably many times between these states.

Figure 8:
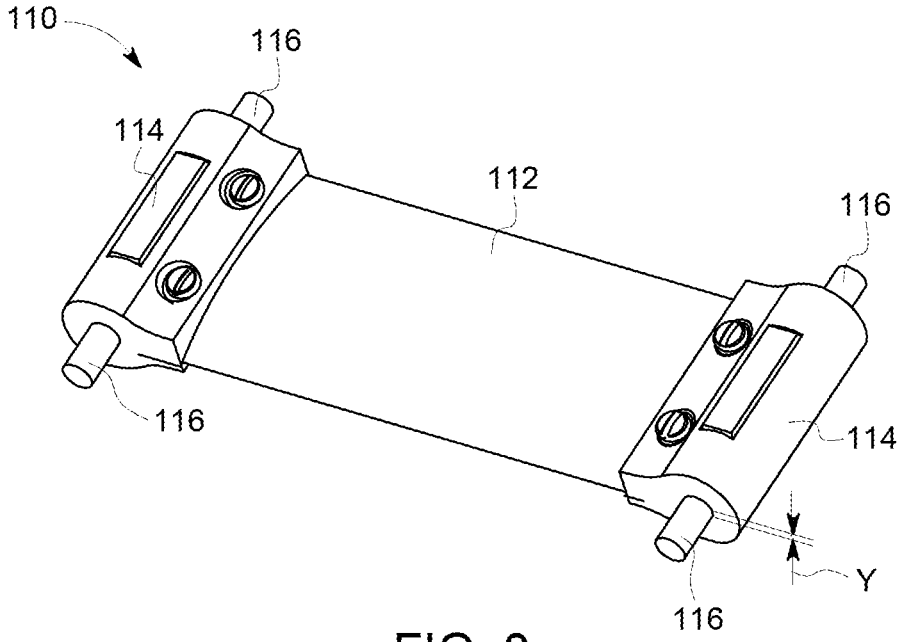
FIG. 8 is a perspective view of the yieldable support of the circuit breaker of FIG. 1.
Figure 9:
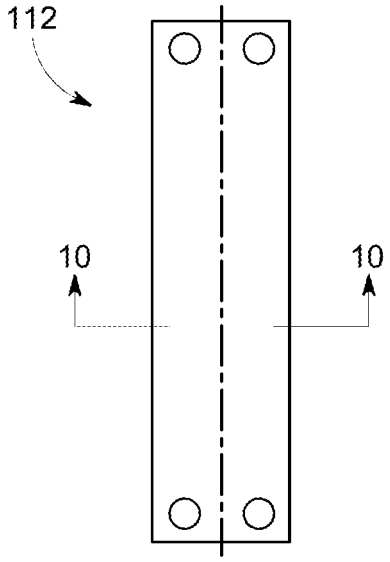
FIG. 9 is an elevational view of the yieldable member of the support of FIG. 8.
Figure 10:
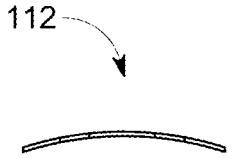
FIG. 10 is a cross-sectional view of the yieldable member of the yieldable support taken along line 10-10 of FIG. 9.
Figure 11:
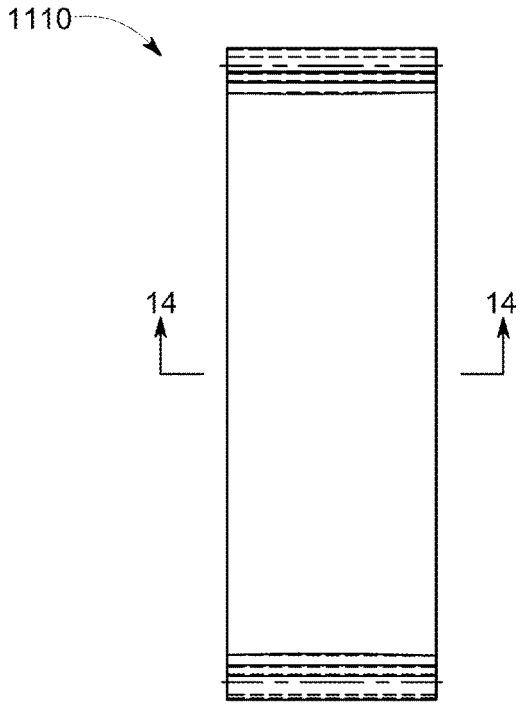
FIG. 11 is an elevational view of a yieldable support according to another embodiment of the present disclosure.
Figure 12:
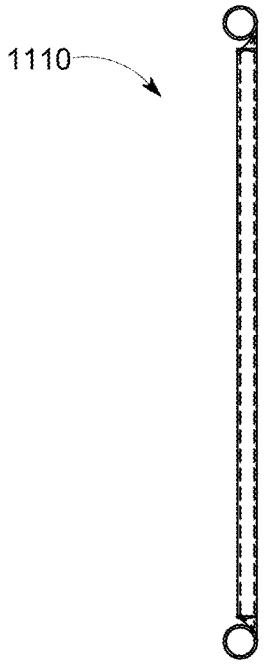
FIG. 12 is a side elevational view of the yieldable support of FIG. 11.
Figure 13:
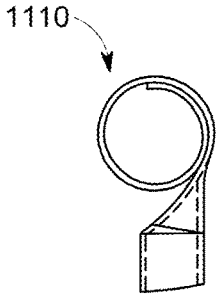
FIG. 13 is an enlarged side elevational view of an end portion of the yieldable support of FIG. 11.
Figure 14:
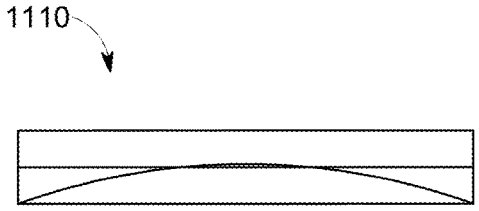
FIG. 14 is an enlarged cross-sectional of the yieldable support view taken along line 14-14 in FIG. 11.

FIGS. 8-10 illustrate one embodiment of yieldable support 110 according to an embodiment of the present disclosure. In this embodiment, yieldable support 110 may be yieldable member 112 such as an elongated member, a flat elongated member, a thin-shaped foil, a ribbon, etc., other suitable configured member or members, supported between two end mounts 114 which may also contain revolute joints or pins 116. In this embodiment, the elongated member may be a foil or a ribbon having a semi-circular or a curved-shapes cross-section that may be maintained throughout its length. The ribbon is attached to the end mounts and secured with fasteners. Other attachment means to secure the ribbon other than fasteners may be suitably employed. The center or axis of pins 116 may be offset relative to the ribbon a distance Y. Distance Y may be defined as the distance between the edge of the ribbon and the center of the pin measured orthogonal to the yieldable support axis.

As described above, the circuit breaker may be disposed in a closed ON position with the yieldable support disposed in a rigid mode. In this mode, the yieldable support may be loaded axially, that is in a direction along a line between the pins, to a large extent and remain at a low stress state that can be retained for an extended period of time, if not indefinitely. The ribbon cross-section of the yieldable support, ribbon thickness, and offset may be chosen such that when the yieldable support is loaded axially, a small input force may be applied to or near the midpoint of the ribbon orthogonal to the axis of the ribbon, so that it will buckle or bend and enter a compliant mode. In this bending or compliant mode, the end displacements may limit the deflection on the order of ⅕ the length of the yieldable support so that the ribbon stresses remain reasonably small and elastic, e.g., so that little or no permanent deformation or damage is imparted to the ribbon. It will be appreciated that with the semicircular cross-sectional shape of the ribbon, the ribbon is asymmetric and may have an asymmetric response to bending or buckling. The offset specification may also affect the asymmetry of bending or buckling.

In this embodiment of the yieldable support, the end mounts may be single or monolithic units made of metal or plastic that can accommodate the ribbon in a slot. Plastic end mounts can be injection molded. Metal end mounts can be injection molded, cast, or machined. Fastening of the ribbon to the mounts may be accomplished by various fasteners, adhesive, brazing, diffusion bonding, etc. The ribbon may include a constant cross-section and be manufactured by a continuous processes such as shape rolling, extrusion, or other means. In other embodiments, the ribbon may have a non-constant cross-section, and manufactured by a non-continuous process. While the disclosure describes and illustrates the yieldable support having semi-circular shape with constant cross-section, it will be appreciated that other shapes and configuration may be suitably employed to provide a rigid mode and a compliant mode. In other embodiments, a yieldable support may comprise a plurality of thin-shaped foils or ribbons such as separate or parallel thin-shaped foils or ribbons and may have a semi-circular or curved-shape cross section. Such as plurality of thin-shaped foils or ribbons may allow for tuning or tailoring the stiffness/bending/buckling characteristics with geometrical constraints. Other geometric properties may affect the load capacity in the rigid mode, response in the compliant mode, and the required force input for transition may include tailoring the yieldable support response based on the width of the ribbon, the length of the ribbon, the thickness of the ribbon, the curvature of the ribbon, the material for the ribbon, the yieldable support placement with respect to the end pivots (e.g., offset), as well as other properties.

FIGS. 11-14 illustrate a yieldable support 1110 according to an embodiment of the present disclosure. Yieldable support 1110 may comprise a one-piece or monolithic design. The ribbon and pin constraints may be formed from a single sheet. For example, an end mount may include integrated pin of the same material. In other embodiments, a yieldable support design such as shown in FIGS. 11-14 may be formed from two or more separate pieces that are assembled together. The end mounts may include integrated pins or separately attached pins of the same material.

In the above embodiments of the yieldable supports, the unconstrained state or configuration may be a rigid state or rigid mode. That is to say, if all outside forces and displacements are removed, the yieldable supports will naturally relax into their unconstrained state or extended state. Thus, restoration from a compliant state or mode to the rigid state or mode may be accomplished by removing the transition energy input or triggering input and allowing the end pins to freely rotate.

As noted above, the transition of the yieldable support from the rigid mode to the compliant mode may include a trip bar, solenoid, and control unit. In other embodiments, other or multiple types of energy can be employed to force the transition of the yieldable support from the rigid mode to the compliant mode. For example, a magnetic or electromagnetic field could be used to alter the state of a metal ribbon, causing it to bend or buckle. In another embodiment, a ribbon may be made from a bimetallic material or strip that is alterable into the compliant state by temperature changes. A torque could be applied to one and/or both end mounts to cause a rotation and a bending or buckling of the yieldable support and a transition from the rigid mode to the compliant mode.

FIG. 15 diagrammatically illustrates a yieldable support 2110 according to an embodiment of the present disclosure. In this illustrated embodiment, yieldable support includes two or more rigid links such as link 2112 and link 2114. The links may be connected by revolute or semi-revolute joints 2210, 2212, and 2214. The revolute joints may be disposed at the end mounts to provide two sets of revolute joints, e.g., two end-revolutes and one or more inner-revolutes. Lower revolute joint 2214 may be pinned, for example, pined to a frame of a circuit breaker.

As described below in connection with a rigid mode and a compliant mode, a reference line L extends between the end revolutes. In an embodiment of yieldable support 2110, the two rigid links may be of equal length and thus contain one inner revolute. Inner revolute 2212 may be offset a distance W from end-revolute line L.

In a compliant mode, if all revolutes are free to rotate and there are no other constraints imposed, the yieldable support 2110 will have little or no resistance to the end displacement. For example, since the links are rigid, the yieldable support will accommodate a change in configuration by rotation of the links and displacement of inner revolute 2112 further from end-revolute line L as one of the ends is displaced toward the other in the direction of the end-revolute line. In a rigid mode, inner revolute 2112 of yieldable support 2110 may be restrained. For example, the transformation to a rigid mode is accomplished by removing some of the degrees of freedom, such as by converting the inner revolute to non-rotating or supporting the inner link to limit its movement.

FIGS. 16 and 17 illustrate one embodiment of a transition from a rigid mode (FIG. 16) to a compliant mode (FIG. 17) where the inner revolute is restrained in the rigid mode. FIGS. 18 and 19 illustrate another embodiment of a transition from a rigid mode (FIG. 18) to a compliant mode (FIG. 19) where the inner revolute is, for example, limited in its rotation. In the various embodiments, the transition force may be proportional to the applied axial force and displacement distance of the inner revolute. To reset the yieldable support, the upper revolute may be forced upward or a torsional or linear force may be applied to the inner revolute. As will be appreciated, a yieldable support having rigid links may be incorporated into a circuit breaker such as circuit breaker 10 (FIG. 1).

With reference to FIGS. 20 and 21, blocking member 150 may include a generally V-shaped configuration having a first leg 157 and a second leg 159. The lower end 154 of the first leg may be pinned via pin 24 to frame 20 (FIG. 1).

With reference again to the blocking member, an actuation mechanism or a circuit breaker may include a blocking member that operates in different axes of rotation (i.e. rotate about some off-axis compared to the axis of rotation of the contact arm). A blocking member may have a fixed point of rotation and include rigid elements or be made compliant or flexible (e.g., configured and providing features similar to a yieldable support) and not have an axis of rotation. For example, in this case such a blocking member may flex to move in and out of a blocking position. The blocking member can be triggered to release via many different means: the crank position, the handle position, a separate button, a logic controller, etc. A blocking member may also be made to be rotation-axis-free. That is, a blocking member may be fastened to a base of a frame and elastically flex to achieve a blocking configuration and a non-blocking configurations, e.g., a compliant embodiment.

In other embodiments, a blocking member may operate passively and not require a separate releasing mechanism, e.g., not required a cutout and stop as previously described above. In this embodiment, a reach of a movable contact arm changes as the system is turned on. The blocking member may be set so it interferes with the movable contact arm for all positions except for when the handle is forward in the ON position. A dual-pivot design of the movable contact arm may establish and control this interference. During a trip, a blocking member may ratchet to allow the movable contact arm to freely pass.

FIG. 22 illustrates one embodiment of a method 300 for actuating a moveable arm. Method 300 may include, for example, at 310 applying a force to move the movable arm in a first direction, at 320 supporting, with a yieldable support disposed in a rigid configuration defining a straight axis, a compression force along the straight axis due to and countering the force applied to the movable arm to prevent the movable arm from moving in the first direction, and at 330 applying a tripping force to the yieldable support to transition the rigid configuration to a flexible configuration having a non-straight axis and withdraw support of the compression force to allow the movable arm to move in the first direction.

FIG. 23 illustrates one embodiment of a method 400 for actuating a circuit breaker for opening and closing electrical contacts. Method 400 may include, for example, at 410 applying a first force operable to move a movable arm in a first direction to open the electrical contacts, at 420 applying a second force operable to the movable arm a second direction to close the electrical contacts, at 430 supporting, with a yieldable support disposed in a rigid configuration defining a straight axis, a compression force along the straight axis due to and countering the first force applied to the movable arm to prevent opening of the closed electrical contacts, and at 450 applying a tripping force to the yieldable support to transition the rigid configuration to a flexible configuration having a non-straight axis and withdraw support of the compression force to allow opening of the closed electrical contacts.

FIG. 24 illustrates one embodiment of a method 500 for moving a movable arm to effect a quick-make feature. Method 500 may include, for example, at 510 engaging the movable arm with a blocking member to restrain movement of the movable arm in a first direction, and at 520 disengaging the movable arm from the blocking member to allow movement of the movable arm in the first direction.

FIG. 25 illustrates one embodiment of a method 600 for actuating a circuit breaker for opening and closing electrical contacts. Method 600 may include, for example, at 610 engaging a movable arm with a blocking member to restrain movement of the movable arm in a first direction and maintain the electrical contact open, and at 620 disengaging the blocking member from the movable arm to allow movement of the movable arm in the first direction to close the electrical contacts.

FIG. 26 illustrates an embodiment of a circuit breaker 3010 such as a latch-free circuit breaker according to an embodiment of the present disclosure. For example, as shown in FIG. 26, circuit breaker 3010 is disposed in an ON-state or position. The embodiment of FIG. 26 is used to illustrate features of the present disclosure, however it will be appreciated that the present disclosure is not to be limited to the configuration of the circuit breaker illustrated in FIG. 26.

Circuit breaker 3010 generally includes a frame 3020, a stationary contact arm 3030, a movable contact arm 3040, and an actuator/trigger mechanism 3100. Actuator/trigger mechanism 3100 may generally include a yieldable support 3110, a handle 3120, a crank 3130, a blocking member 3150, and a trip bar 3160. As described in greater detail below, yieldable support may have a rigid configuration defining a straight axis and a flexible configuration defining a non-straight axis. The yieldable support is operable in the rigid configuration to support a compression force along the straight axis for use in charging or energizing the circuit breaker and maintaining the circuit breaker in a closed configuration. The yieldable support is operable in the flexible configuration or resilient bent configuration to allow the circuit breaker to quickly transition to an open configuration.

As shown in FIG. 26, movable contact arm 3040 includes a first end 3041 having a movable contact 3042, and a second end 3043 pivotally attached to frame 3020 and rotatable about a pin 3022. Stationary contact arm 3030 includes a stationary contact 3032. Yieldable support 3110 includes an upper end operably attachable to handle 3120, and a lower end operably attachable to crank 3130. Crank 3130 is pivotable about pin 3022 and includes two sets of biasing means such as springs, for example, a first biasing means such as a main spring 3132 and a second biasing means such as a contact spring 3134.

FIGS. 27-29 illustrate the operation of moving circuit breaker 3010 from an OFF-state or position to an ON-state or position and which provides a quick-make wherein the speed of the closing of the electrical contacts is made independent of how fast the handle is moved. For example, FIGS. 27-29 illustrate circuit breaker 3010 disposed in an open OFF position (FIG. 27), a beginning of a transition from an open OFF position to a closed ON position (FIG. 28), and in a closed ON position (FIG. 29).

Initially, with reference to FIG. 27 and with circuit breaker 3010 disposed in an open OFF position with handle 3120 disposed in a left most position (not shown in FIG. 27) handle 3120 is moved from the left most position in the direction of arrow J towards the illustrated position. The movement of the handle from left to right is transmitted via yieldable support 3110 in a rigid configuration to cause a clockwise rotation of crank 3130 in the direction of arrow K. During this operation, the yieldable support 3110 remains rigid and does not flex. As crank 3130 is rotated clockwise, the two sets of springs, main spring 3132 and contact spring 3134 (partial views of the spring sets being best shown in FIG. 26) are charged or wound up to increase their stored energy. Main spring 3132 (FIG. 26) acts to resist the handle movement, and in the absence of the reaction provided by yieldable support 3110, will rotate crank 3130 counterclockwise as described below. Contact spring 3134 (FIG. 26) acts between movable contact arm 3040 and crank 3130 (or alternatively between a movable contact arm and a base) and serves to provide a contact force between movable contact 3042 of movable contact arm 3040 and stationary contact 3032 of stationary arm 3030 when in a closed position. The contact force is operable to reduce electrical contact resistance and any concomitant rise in temperature.

In addition, as shown in FIG. 27, movable contact arm 3040 exhibits a full open OFF position with a large gap between electrical contacts 3032 and 3042. Both sets of springs in crank 3130, main spring 3132 (FIG. 26) and contact spring 3134 are charged with elastic energy resulting in a moment that is acting to move movable contact arm 3040 downwardly, but any downward movement of movable contact arm is prevented by stop 3044 of movable contact arm 3040 resting in, engaging, and being restrained in a cutout 3152 in blocking member 3150.

As further illustrated in FIG. 27, blocking member 3150 includes a lower end 3154 pivotally attached to a base of frame 3020 via pin 3024, and an upper end 3156 operably engageable with a stop 3026 attached to frame 3020. For example, a spring 3158 normally biases upper end 3156 of blocking member 3150 toward and against stop 3026, e.g., spring 3158 provides a restoring force to upper end 3156 of blocking member 3150. As noted above, blocking member 3150 provides an additional point of contact and restraint for movable contact arm 3040. For example, movable contact arm 3040 includes stop 3044 (best shown in FIG. 26) such as a projection extending outwardly from movable contact arm 3040. Stop 3044 is releasable engageable and disposable in saddle or cutout 3152 in blocking member 3150. Depending on the position of blocking member 3150, saddle or cutout 3152 restrains stop 3044 of movable contact arm 3040 from movement, and in effect restrains movable contact arm 3040 from moving from an open OFF position to a closed ON position.

As described below, blocking member 3150 along with yieldable support 3110, movable contact arm 3040, and crank 3130 allows circuit breaker 3010 facilitate a quick-make feature where the contacts may be closed quickly. For example, the electrical contacts may be closed on the order of a few milliseconds from the fully open position to the closed position.

With reference to FIG. 28, to close the electrical contacts, handle 3120 is further moved to the right in the direction of arrow L. A downward projection 3122 attached to or part of handle 3120 engages and begins to force upper end 3156 of blocking member 3150 to the right in the direction of arrow M and pivot blocking member 3150 about pivot point 3024 in the direction of arrow N. As handle 3120 moves to the fully forward position (as shown in FIG. 29), upper end 3156 of blocking arm 3150 moves forward, cutout 3152 moves to the right with stop 3044 of blocking arm 3040 riding along the lower inside portion of cutout 3152 until stop 3044 is no longer restrained in cutout 3152 as shown in FIG. 28.

Once stop 3044 is no longer restrained in cutout 3152, as shown in FIG. 28, movable contact arm 3040 is released and allowed to rotate. In particular, the force exerted by crank 3130 on movable contact arm 3040 (not the force applied by the operator to the handle) causes movable contact arm 3040 to pivot about pin 3024 so that movable contact arm moves downwardly in the direction of arrow M, as shown in FIG. 28, until electrical contact 3042 contacts stationary contact 3032 with circuit breaker 10 disposed in a closed ON position as shown in FIG. 29. The final movement of the contact arm may be accomplished quickly, on the order of a few milliseconds. It will be appreciated that with the components thus described, the speed at which the contact gap is closed is independent on the speed that the handle is moved from the OFF configuration to the ON configuration. For example, the electrical contact may be closed in about 2 milliseconds to about 10 milliseconds.

From the present description with reference to FIGS. 27-29, it will be appreciated that in moving the handle from a fully open OFF position to the closed ON position (FIG. 29), crank 3130 will move in a clockwise rotation (FIG. 27), due to movement of handle 3120 being transferred via yieldable support 3110. Further, main spring 3132 (FIG. 26) resists this movement and increases its stored energy. Contact spring 3134 (FIG. 26) forces movable contact arm 3040 to either come to rest on a cross beam 3138 (FIG. 26) of crank 3130 or stationary contact 3032, which is dependent on the position of the crank. For example, if crank 3130 is at or near the full clockwise position, then movable electrical contact 3042 will rest on stationary contact 3032 (e.g., a pre-defined or predetermined clearance keeps the components from contacting each other), and if the crank is in any other position, a lower portion of movable contact arm 3040 will rests on cross beam 3138 (FIG. 26) of crank 3130. It will also be appreciated that the reaction forces on handle 3120 via the flexure-crank-main spring assemblage may serve to keep handle 3120 in either an OFF or an ON position once placed there by an operator.

FIGS. 29, 30, and 27 illustrate the operation of moving circuit breaker 3010 from the secure ON-state or position to an OFF-state or position and which provides a quick-break wherein the speed of the opening of the electrical contacts is occurs quickly. For example, FIGS. 29, 30, and 26 illustrate circuit breaker 3010 disposed in a secured closed ON position (FIG. 29), a tripping or beginning of a transition from a closed ON position to an open OFF position (FIG. 30), and a fully open tripped OFF position (FIG. 27).

As described in greater detail below, the latch-free circuit breaker may have a quick-break feature provided generally by yieldable support 3110 operable in, for example, two configurations or modes, a rigid configuration or rigid mode and a flexible configuration or compliant mode. As noted above and as shown in FIG. 29, yieldable support 3110 is operable for carrying an axial load between two pivot points in the rigid mode, and supporting the axial load for an extended period of time. For example, yieldable support 3110 is operable for carrying an axial load P to maintain crank 3130 in position and movable arm in a closed position.

In addition, as shown in FIG. 30, yieldable support 3110 may be tripped by trip bar 3160 moving in the direction of arrow S to apply a direct force H on yieldable support 3110 along it length to deform, buckle, or bend yieldable support 3110 so that yieldable support 3110 transitions to a compliant mode, which offers little resistance to the axial load maintaining crank 3130 in a clockwise position and movable arm in a closed position. Upon yieldable support 3110 being tripped and transitioning to the compliant or flexible mode offering reduced or little axial resistance, crank 3130 rotates counter-clockwise about pin 3022 in the direction of arrow Z, and movable contact arm 3030 pivots about pivot 3022 in the direction of arrow Y to quickly open electrical contacts 3032 and 3042, as shown in FIG. 28.

For example, if crank 3130 is in its counterclockwise position, the contact spring will drive movable contact arm 3040 to rest on cross beam 3138 with some force. To reset the circuit breaker, handle 3120 is moved to the left which causes yieldable support return to its rigid configuration. For example, as described above, yieldable support may have a curved cross-section so that when handle 3120 is moved to the left, the yieldable support snaps back into in to its normal rigid configuration. It will be appreciated that other cross-sections such as round or oval and employing suitable materials and stiffness, may provide a yieldable support which is elastically bendable and which snaps back to its normal rigid configuration after being bent.

With reference again to FIG. 26, an electromagnetic solenoid 3170 may be operably connected to trigger the movement of trip bar 3160 which transitions yieldable support 3110 from a rigid mode to a compliant mode and releases moveable contact arm 3040 from contact with stationary arm 3030. Solenoid 3170 may controlled via an electronic unit or controller 3175, which performs diagnostic tests prior to effecting the tripping of the circuit breaker. While the description is made to a single-pole breaker, it will be appreciated that the technique of the present disclosure may be applied to 2, 3, or more pole circuit breaker.

From the present description, it will be appreciated that the yieldable support can be readily changed from rigid to compliant with a small energy input in the form of a force, torque, thermal energy, electromagnetic energy, pressure, etc., and likewise the yieldable support can be reset from the compliant mode to the rigid mode with little effort. The yieldable support may be cycled reliably many times between these states.

As described above, the yieldable support may be a resilient member such as a link, links, foil flexure, ribbon, flexure membranes, and a first and a second revolute joints which allow pinned connections. The two end revolute joints or end mounts may be disposed parallel to each other and separated about 25 millimeter to about 40 millimeter for in one or more embodiments of the circuit breakers, or more or less, for example, for other applications. The pin end connections can be joined to other linkages or assemblies as required and can or alternately not be free to rotate.

In the first or rigid mode, the yieldable support may be capable of supporting a large load in the axis of the yieldable support (i.e. following a line at or nearly along a line drawn between the revolute joints or end mounts). In the application in a circuit breaker, the supported axial load may be in the order of about 100 Newtons to about 400 Newtons, and the pins may have a diameter of about 2 millimeters to about 3 millimeters. In the rigid mode, the link is capable of holding this load for an extended period of time (up to the order of 10^8 seconds) and may be resilient to shock vibrations and other harsh environmental conditions such as elevated temperature, humidity, etc.

In the second or compliant mode, the pins may be allowed to contract towards each other with little or no resistance. In the application for use in circuit breakers, the pins may contact towards each other in the compliant mode on the order of ⅕ the separation distance or about 5 millimeters to about 8 millimeters, or other suitable distance depending on the particular retirements of the application.

In the transitioning from the rigid mode to the compliant mode of the yieldable support, an input is required to set or change the configuration of the yieldable support. The input can be in the form of a force, impulse load, torque, thermal energy, electromagnetic energy, pressure, etc. It is desirable to have a low configuration-changing input energy threshold. For example, for use in a circuit breaker, an input energy may be in the form of a force on the order of about 1 newton to about 2 Newtons.

The transiting the yieldable support from the compliant mode to the rigid mode may be achieved by removing the input transition energy and restoring the pins to the original separation distance. No other input may be required. It is noted that the two requirements for a successful transition behave like a logical AND operation: both to be satisfied to return the device to the rigid mode, and if not, the device remains in the compliant mode as shown in Table 1 below.

TABLE 1

Device State Dependencies

| Energy input state | End pin state | Device state |
|---|---|---|
| Energy input applied | End pins extended | Compliant state |
| Energy input not applied | End pins extended | Rigid state |
| Energy input applied | End pins contracted | Compliant state |
| Energy input not applied | End pins contracted | Compliant state |

Thus the device may be classified as having two stable states with transition operations to alter the configuration between these states. These are summarized in Table 2 below.

TABLE 2

| Bimodal Link States | | | | |
|---|---|---|---|---|
| | State/transition | | | |
| | Rigid state | Rigid-to-compliant transition | Compliant state | Compliant-to-rigid transition |
| Description | Behaves as rigid linkage. Separation distance between parallel pins is constant or nearly so under load. Resistant to shock loading. Able to maintain state for long periods of time | Low-order energy input is required to transition. Energy can be in form of force, torque, pressure, thermal energy, etc. | Behaves as a compliant linkage. Pins can freely contract toward each other with little resistance. | Device resets upon extending the pins to the rigid state separation distance and removing the energy input. |

The technique of the present disclosure may be effectively employed in electrical switching devices where large loads are required to be supported to provide a positive electrical-contact force, yet a small input of energy or force is required to release it. In the case of circuit breakers, tripping of the electrical contacts may be accomplished with a little impulse, such as one supplied by a heated bi-metallic element, or other devices as described above.

Table 3 illustrates the results for 40 millimeter ribbon length and 0.12 mm thickness yieldable supports.

TABLE 3

| Radius (mm) | Width (mm) | Offset (mm) | Hor. Load (N) For 65 N Axial Load | Buckling load (N) |
|---|---|---|---|---|
| 10 | 10 | −0.7 | 1.109 | 71.92 |
| 10 | 10 | −1.1 | 3.396 | >105 |
| 10 | 10 | −1.4 | 5.26 | 65.39 |
| 10 | 12.5 | −1.1 | 3.218 | 72.44 |
| 10 | 12.5 | −1.7 | 6.298 | >105 |
| 10 | 12.5 | −2.3 | 9.346 | 70.3 |
| 10 | 15 | −1.7 | 2.873 | 69.34 |
| 10 | 15 | −2.3 | 9.022 | 100.3 |
| 10 | 15 | −2.9 | >10 | 67.27 |
| 17 | 10 | Does not support 65 N/Very small offset range | | |
| 17 | 12.5 | −0.6 | 0.575 | 71.72 |
| 17 | 12.5 | −0.9 | 2.1 | >105 |
| 17 | 12.5 | −1.2 | 3.913 | 73.22 |
| 17 | 15 | −0.8 | 1.443 | 74.13 |
| 17 | 15 | −1.3 | 3.725 | >105 |
| 17 | 15 | −1.8 | 6.256 | 79.62 |
| 24 | 10 | Does not support 65 N/Very small offset range | | |
| 24 | 12.5 | Does not support 65 N/Very small offset range | | |
| 24 | 15 | −0.6 | 0.174 | 68.47 |
| 24 | 15 | −0.9 | 1.796 | >105 |
| 24 | 15 | −1.2 | 3.516 | 80.05 |

FIG. 26 is a main effects plot for horizontal load. FIG. 27 is a main effects plot for buckling load. FIG. 28 is a main effects plot for axial and kicker at buckle.

It will be appreciated that the technique of the present disclosure may be used in a toggle-type breaker. In this case, an actuator may be used to make the final arbitration to close the contact arms and would be activated either with another input from the user or via an electronic control unit (which would close the contacts after some self-diagnostic tests.

It is to be understood that the above description is intended to be illustrative, and not restrictive. Numerous changes and modifications may be made herein by one of ordinary skill in the art without departing from the general spirit and scope of the disclosure as defined by the following claims and the equivalents thereof. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Also, the term "operably" in conjunction with terms such as coupled, connected, joined, sealed or the like is used herein to refer to both connections resulting from separate, distinct components being directly or indirectly coupled and components being integrally formed (i.e., one-piece, integral or monolithic). Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure. It is to be understood that not necessarily all such objects or advantages described above may be achieved according to any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments have been described, it is to be understood that aspects of the disclosure may include only some of the described embodiments. Accordingly, the disclosure is not to be seen as limited by the foregoing description, but is only limited by the scope of the appended claims.

This written description uses examples, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A circuit breaker having a quick-make feature, the circuit breaker comprising:

a frame;

a stationary electrical contact attached to said frame;

a movable arm having a first end attachable to said frame and a second end having an electrical contact releaseably contactable with said stationary electrical contact; and an actuator mechanism comprising:

a main biasing means operable to apply a first force to move said movable arm in a first direction to open said electrical contacts;

a contact biasing means operable to apply a second force to move said movable arm in a second direction to close said electrical contacts; and a blocking member comprising an elongated member having a portion disposed between a first end and a second end, wherein said blocking member is configured so that said portion of said elongated member engages a portion of said movable arm to restrain movement of said movable arm by said main biasing means and maintain said electrical contacts open when said blocking member is disposed in a first position, and so that said portion of said elongated member disengages from said portion of said movable arm to permit movement of said movable arm by said contact biasing means to close said electrical contacts when said blocking member is disposed in a second position, wherein said movable arm is disposed through said blocking member in both said first position and said second position.

2. The circuit breaker of claim 1, wherein said actuator further comprises a handle movable a first distance to move said blocking member said first distance while movement of said movable arm in said second direction is restrained, and said handle being movable an additional distance to disengage said blocking member from said movable arm to allow said contact biasing means to close said electrical contacts.

3. The circuit breaker of claim 1, further comprising a trigger operable for allowing said main biasing means to open the closed electrical contacts.

4. The circuit breaker of claim 1, wherein said second direction is opposite from said first direction.

5. The circuit breaker of claim 1, wherein said main biasing means comprises a spring, and said contact biasing means comprises a spring.

6. The circuit breaker of claim 1, wherein said first end of said blocking member is pivotably or fixedly attachable to said frame.

7. The circuit breaker of claim 1, wherein disengaging said blocking member from said movable arm allows said contact biasing means to close said electrical contacts in less than 10 milliseconds.

8. The circuit breaker of claim 1, wherein said portion of said movable arm comprises a pin.

9. The circuit breaker of claim 1, wherein said portion of said elongated member comprises a cutout for receiving said portion of said movable arm.

10. The circuit breaker of claim 9, wherein said cutout is disposed between said first end and said second end of said elongated member.

11. The circuit breaker of claim 1, wherein said blocking member defines a groove for receiving said movable arm therebetween.

12. The circuit breaker of claim 1, wherein said blocking member comprises a V-shaped configuration.

13. The circuit breaker of claim 1, wherein said second end of said blocking member is movable in response to movement of a handle.

14. A method for actuating a circuit breaker for opening and closing electrical contacts, the method comprising:

engaging a movable arm with a portion of a blocking member to restrain movement of said movable arm in a first direction and maintain said electrical contacts open, wherein said portion of said blocking member is disposed between a first end and a second end of an elongated member, and wherein said movable arm is disposed through said blocking member when said moveable arm is engaged with said portion of said blocking member; and disengaging said portion of said blocking member from said movable arm to allow movement of said movable arm in said first direction to close said electrical contacts, wherein said movable arm is disposed through said blocking member when said portion of said blocking member is disengaged from said moveable arm.

15. The method of claim 14, wherein the engaging comprises moving said blocking member to a first distance while restraining movement of said movable arm in said first direction and maintain said electrical contact open, and the disengaging comprises moving said blocking member to an additional distance to disengage said blocking member from said movable arm to close said electrical contacts.

16. The method of claim 14, wherein the engaging comprises moving a handle to a first distance while restraining movement of said movable arm in said first direction and maintain said electrical contact open, and the disengaging comprises moving said handle to an additional distance to disengage said blocking member from said movable arm to close said electrical contacts.

* * * * *